US008370150B2

(12) United States Patent
Toiyama et al.

(10) Patent No.: US 8,370,150 B2
(45) Date of Patent: Feb. 5, 2013

(54) CHARACTER INFORMATION PRESENTATION DEVICE

(75) Inventors: Keiichi Toiyama, Osaka (JP); Mitsuteru Kataoka, Osaka (JP); Kohsuke Yamamoto, Osaka (JP)

(73) Assignee: Panasonic Corporation, Osaka (JP)

( * ) Notice: Subject to any disclaimer, the term of this patent is extended or adjusted under 35 U.S.C. 154(b) by 625 days.

(21) Appl. No.: 12/669,278

(22) PCT Filed: Jul. 15, 2008

(86) PCT No.: PCT/JP2008/001892

§ 371 (c)(1),
(2), (4) Date: Jan. 15, 2010

(87) PCT Pub. No.: WO2009/013875

PCT Pub. Date: Jan. 29, 2009

(65) Prior Publication Data

US 2010/0191533 A1 Jul. 29, 2010

(30) Foreign Application Priority Data

Jul. 24, 2007 (JP) ..... 2007-191713

(51) Int. Cl.
*G10L 13/00* (2006.01)

(52) U.S. Cl. ..... 704/260; 704/258

(58) Field of Classification Search ..... 704/258, 704/260

See application file for complete search history.

(56) References Cited

U.S. PATENT DOCUMENTS

| | | | | | |
|---|---|---|---|---|---|
| 5,204,905 | A | * | 4/1993 | Mitome | 704/260 |
| 5,396,577 | A | * | 3/1995 | Oikawa et al. | 704/260 |
| 5,555,343 | A | * | 9/1996 | Luther | 704/260 |
| 5,752,228 | A | * | 5/1998 | Yumura et al. | 704/260 |

FOREIGN PATENT DOCUMENTS

| | | | |
|---|---|---|---|
| JP | 03-214984 | | 9/1991 |
| JP | 05-313686 | | 11/1993 |
| JP | 06-067685 | | 3/1994 |
| JP | 06-067685 | A | 3/1994 |
| JP | 08-328577 | | 12/1996 |
| JP | 11-007295 | | 1/1999 |
| JP | 2005-062420 | A | 3/2005 |
| JP | 2005-062420 | A | 3/2005 |
| JP | 2005-316031 | A | 11/2005 |
| JP | 2005-316031 | A | 11/2005 |
| WO | WO-2006129247 | A1 | 12/2006 |
| WO | PCT/JP2008/001892 | | 10/2008 |

OTHER PUBLICATIONS

European Application Serial No. 08776851.1, Extended European Search Report dated Dec. 16, 2011, 4 pgs.

* cited by examiner

*Primary Examiner* — Daniel D Abebe
(74) *Attorney, Agent, or Firm* — RatnerPrestia

(57) ABSTRACT

The text information presentation device calculates an optimum readout speed on the basis of the content of text information being input, its arriving time, and its previous arriving time; speech-synthesizes text information being input, at the readout speed calculated; and outputs it as an audio signal, or alternatively controls the speed at which a video signal is output according to an output state of the speech synthesizing unit.

13 Claims, 18 Drawing Sheets

FIG. 2

| Data structure |
| --- |
| struct strbuff{<br>int64 time;<br>char str[256];<br>};<br><br>struct stringFIFO{<br>strbuff buff[5];<br>int laststr;<br>}; |

FIG. 3

301 302

| | Time information | Stored text string |
|---|---|---|
| Text string buffer 1 | 12:00:00 | NEXT IS WEATHER FORECAST |
| Text string buffer 2 | 12:00:03 | WEATHER IS FINE IN THE NORTHERN AREA |
| Text string buffer 3 | 12:00:07 | BUT PARTLY CLOUDY IN THE SOUTHERN AREA |
| Text string buffer 4 | | |
| Text string buffer 5 | | |

| | |
|---|---|
| Last data position | Text string buffer 3 |

303

FIG. 5

501 502

| word | duration |
|---|---|
| area | 2.0 |
| but | 1.0 |
| cloudy | 2.0 |
| fine | 1.5 |
| forecast | 2.5 |
| in | 1.0 |
| is | 1.0 |
| next | 1.5 |
| northern | 2.0 |
| partly | 1.5 |
| southern | 2.0 |
| sunny | 1.5 |
| the | 1.0 |
| today | 1.5 |
| tomorrow | 2.5 |
| weather | 2.0 |

FIG. 6

601

| | |
|---|---|
| Time information | 12:00:00 |

FIG. 8

| Data structure |
| --- |
| struct strbuff{<br>int64 display_time;<br>int64 erase_time;<br>char str[256];<br>};<br><br>struct stringFIFO{<br>strbuff buff[5];<br>int laststr;<br>}; |

FIG. 9

| | 901 Presentation time information | 902 Erasing time information | 903 Stored text string |
|---|---|---|---|
| Text string buffer 1 | 12:00:00 | 12:00:03 | NEXT IS WEATHER FORECAST |
| Text string buffer 2 | 12:00:03 | 12:00:06 | WEATHER IS FINE IN THE NORTHERN AREA |
| Text string buffer 3 | 12:00:07 | 12:00:09 | BUT PARTLY CLOUDY IN THE SOUTHERN AREA |
| Text string buffer 4 | | | |
| Text string buffer 5 | | | |

| Last data position | Text string buffer 3 |
|---|---|

904

| 1101 word | 1102 duration |
|---|---|
| area | 2.0 |
| but | 1.0 |
| cloudy | 2.0 |
| fine | 1.5 |
| forecast | 2.5 |
| in | 1.0 |
| is | 1.0 |
| next | 1.5 |
| northern | 2.0 |
| partly | 1.5 |
| southern | 2.0 |
| sunny | 1.5 |
| the | 1.0 |
| today | 1.5 |
| tomorrow | 2.5 |
| weather | 2.0 |

FIG. 13

| Data structure |
| --- |
| struct strbuff{<br>int64 time;<br>char str[256];<br>};<br><br>struct stringFIFO{<br>strbuff buff[5];<br>int laststr;<br>}; |

FIG. 14

1401 1402

| | Time information | Stored text string |
|---|---|---|
| Text string buffer 1 | 12:00:00 | NEXT IS WEATHER FORECAST |
| Text string buffer 2 | 12:00:03 | WEATHER IS FINE IN THE NORTHERN AREA |
| Text string buffer 3 | 12:00:07 | BUT PARTLY CLOUDY IN THE SOUTHERN AREA |
| Text string buffer 4 | | |
| Text string buffer 5 | | |

| | |
|---|---|
| The last data position | Text string buffer 3 |

1403

| 1601 word | 1602 duration |
|---|---|
| area | 2.0 |
| but | 1.0 |
| cloudy | 2.0 |
| fine | 1.5 |
| forecast | 2.5 |
| in | 1.0 |
| is | 1.0 |
| next | 1.5 |
| northern | 2.0 |
| partly | 1.5 |
| southern | 2.0 |
| sunny | 1.5 |
| the | 1.0 |
| today | 1.5 |
| tomorrow | 2.5 |
| weather | 2.0 |

FIG. 17

| | 1701 Stored text string arrival time information | 1702 Readout speed history information |
|---|---|---|
| Time information 1 | 12:00:00 | 400 |
| Time information 2 | 11:59:50 | 350 |
| Time information 3 | 11:59:20 | 320 |
| Time information 4 | 11:59:18 | 400 |
| Time information 5 | 11:59:15 | 380 |

FIG. 19

1901

| | Stored text string |
|---|---|
| Text string buffer 1 | NEXT IS WEATHER FORECAST |
| Text string buffer 2 | WEATHER IS FINE IN THE NORTHERN AREA |
| Text string buffer 3 | BUT PARTLY CLOUDY IN THE SOUTHERN AREA |
| Text string buffer 4 | |
| Text string buffer 5 | |

| | |
|---|---|
| The last data position | Text string buffer 3 |

1902

CHARACTER INFORMATION PRESENTATION DEVICE

This Application is a U.S. National Phase Application of PCT International Application PCT/JP2008/001892.

TECHNICAL FIELD

The present invention relates to a text information presentation device that displays text information or that converts text information to voice and outputs the voice, more particularly to adjusting time to present and the speed of presenting.

BACKGROUND ART

A lot of TV programs have been subtitled worldwide with consideration for the hearing impaired or for other reasons. Meanwhile, with the Internet and other media becoming widely used, a variety of text information has been available. However, with downsizing of a device displaying the text information, the screen size has been reduced, undesirably making it difficult to read the text information. To solve the problem, a device converting a text string to voice is devised (refer to patent literature 1 for instance).

FIG. 21 is a block diagram showing a configuration of a conventional readout device. As shown in FIG. 21, a conventional readout device includes tone adjusting unit 2001, voice data storage unit 2002, standard speed data storage unit 2003, replay speed input unit 2004, replay speed ratio calculating unit 2005, control unit 2006, and voice replay unit 2007.

Voice data storage unit 2002 digitally stores voice data. Standard speed data storage unit 2003 stores standard speed data representing replay speed of voice data by the number of words corresponding to the voice data and the standard replay time. Replay speed input unit 2004 provides information on change of the replay speed by the number of words per unit time. Replay speed ratio calculating unit 2005 determines a replay speed ratio from the number of words per unit time provided from replay speed input unit 2004; and the number of words at the standard replay speed. Control unit 2006 outputs voice data, standard speed data, and a replay speed ratio read from voice data storage unit 2002, standard speed data storage unit 2003, and replay speed ratio calculating unit 2005, to tone adjusting unit 2001. Voice replay unit 2007 replays output from tone adjusting unit 2001. In this way, the readout device allows setting replay speed by specifying the number of words per unit time while maintaining tone changes due to fluctuations in replay speed to a constant standard value.

In other words, with a conventional readout device, pronouncing can be ended within a predetermined time by a method such as changing pronouncing speed, if the number of characters of a text string to be read is preliminarily specified or readout time is predetermined. However, for subtitle information where it is unknown when the next text string arrives and how many characters the string contains; and for description on the Internet where addition and update are made by an unspecified large number of people, the number of characters cannot be identified or time required cannot be predetermined, making it difficult to set pronouncing speed to an optimum value.

For a text string displayed or read synchronously to video to be presented to viewers, for such as subtitle information, when the text string is read too fast, it is undesirably difficult to hear. When the text string is displayed and changed too fast, some of it cannot be read within its display period. When the readout speed is lower than the speed of an arriving text string, the video cannot be synchronized to the text string.

With needs of the hearing impaired and improvement of accuracy in voice recognition, service has been available in which a speech produced by an announcer is automatically converted to text strings and multiplexed as subtitles into a broadcast wave. However, an average viewer reads a text string displayed and acknowledges its meaning slower than the viewer listens to and acknowledges the speech. Actually, some words need to be changed to shorter ones and unnecessary words need to be omitted when converting to subtitles, which makes complete automatization difficult.

[Patent literature 1] Japanese Patent Unexamined Publication No. H11-7295

SUMMARY OF THE INVENTION

A text information presentation device according to the present invention includes a memory storing time information on a text string; a text information input unit accepting input of a text string; a text string buffer storing a text string when it is input to the text information input unit, and outputting an update notification signal; and a standard speech-synthesis length calculating unit that reads a text string stored in the text string buffer when receiving an update notification signal and calculates a duration required if the text string is pronounced at a given speed to output a readout duration signal. The text information presentation device further includes a control unit that calculates a readout speed ratio on the basis of a readout duration signal output from the standard speech-synthesis length calculating unit, time information on a text string stored in the text string buffer corresponding to the readout duration signal, and time information on a text string stored in the memory, and output a readout speed ratio signal; and a speech synthesizing unit that issues a readout request to the text string buffer, and speech-synthesizes a text string input from the text string buffer on the basis of a readout speed ratio signal.

Such a configuration allows a text information presentation device to be provided that sets the text string readout speed to an optimum value to ensure audibility even if the frequency of text strings arriving and the number of the characters are not known preliminarily.

In addition, the text information presentation device according to the present invention includes a video information input unit accepting input of video information; a video buffer storing video information input to the video information input unit; and a video presenting unit that reads video information from the video buffer, decodes it, and outputs it as a video signal. The text information presentation device further includes a text information input unit accepting input of a text string; a text string buffer storing a text string input to the text information input unit; and a speech synthesizing unit that reads a text string from the text string buffer, speech-synthesizes it at a given speed, and outputs it as an audio signal; and a control unit controlling at least the video presenting unit. In the text information presentation device, when the speech synthesizing unit has not completed outputting an audio signal synthesized, the video presenting unit outputs a video signal in a nonmoving state. Instead, the video presenting unit outputs a video signal faster or slower.

With such a configuration, control is exercised so that the video presenting unit outputs video in a nonmoving state, or varies the video output speed unless the speech synthesizing unit completes outputting an audio signal synthesized to the audio output unit, and thus a text information presentation device can be provided that allows the viewers easily finish reading even if the frequency of text strings arriving and the number of the characters are not known preliminarily.

BRIEF DESCRIPTION OF DRAWINGS

FIG. 2 schematically shows an example of the data structure of a text string and time information stored in the text string buffer according to the first embodiment of the present invention.

FIG. 3 schematically shows an example of a text string and time information data stored in the text string buffer according to the first embodiment of the present invention.

FIG. 5 schematically shows an example of data stored in the word readout duration standard data part according to the first embodiment of the present invention.

FIG. 6 schematically shows an example of time information stored in the control unit memory according to the first embodiment of the present invention.

FIG. 8 schematically shows an example of the data structure of a text string, time information, and erasing time information stored in the text string buffer according to the second embodiment of the present invention.

FIG. 9 schematically shows an example of data stored in the text string buffer according to the second embodiment of the present invention.

FIG. 13 schematically shows an example of the data structure of a text string and time information stored in the text string buffer according to the third embodiment of the present invention.

FIG. 14 schematically shows an example of data stored in the text string buffer according to the third embodiment of the present invention.

FIG. 17 schematically shows an example of stored text string arrival time information and readout speed ratio history information stored in the control unit memory according to the third embodiment of the present invention.

FIG. 19 schematically shows an example of data stored in the text string buffer according to the fourth embodiment of the present invention.

REFERENCE MARKS IN THE DRAWINGS

Figure 1:
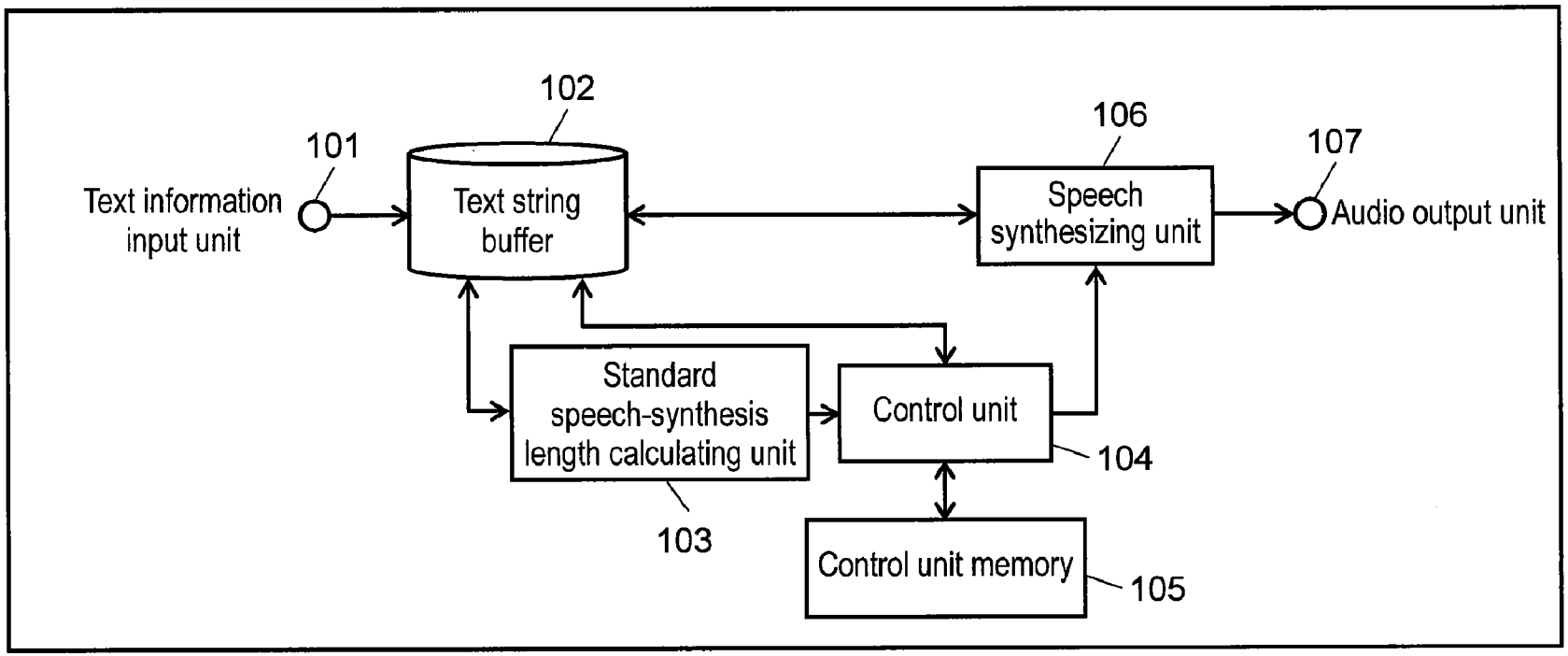
FIG. 1 is a block diagram showing a configuration of a text information presentation device according to the first exemplary embodiment of the present invention.

101, 701, 1201, 1801 Text information input unit
102, 702, 1202, 1802 Text string buffer
103, 703, 1203, 1814 Standard speech-synthesis length calculating unit
104, 704, 1204, 1803 Control unit
105, 705, 1205, 1805 Control unit memory (memory)
106, 706, 1206, 1804 Speech synthesizing unit
107, 707, 1207, 1810 Audio output unit
301, 601, 1401 Time information
302, 903, 1402, 1901 Stored text string
303, 904, 1403, 1902 Last data position
401, 1001, 1501 Control unit for standard speech-synthesis length calculating unit
402, 1002, 1502 Text string temporary storage unit
403, 1003, 1503 Readout duration adding unit
404, 1004, 1504 Word readout duration standard data part
501, 1101, 1601 Word
502, 1102, 1602 Readout duration
901 Presentation time information
902 Erasing time information
1701 Stored text string arrival time information
1702 Readout speed ratio history information
1806 Video information input unit
1807 Video buffer
1808 Video presenting unit
1809 Video output unit
1820 User input unit

DETAILED DESCRIPTION OF PREFERRED EMBODIMENTS

Hereinafter, a description is made of some examples of a text information presentation device according to the present invention using the related drawings.

First Exemplary Embodiment

FIG. 1 is a block diagram showing a configuration of a text information presentation device according to the first exemplary embodiment of the present invention. As shown in FIG. 1, the text information presentation device according to the embodiment includes text information input unit 101, text string buffer 102, standard speech-synthesis length calculating unit 103, control unit 104, control unit memory 105 as a memory storing time information on a text string, speech synthesizing unit 106, and audio output unit 107.

Next, a description is made of operation of the text information presentation device according to the embodiment thus configured. Text information input unit 101 accepts input of a text string. Then, a text string input from text information input unit 101 is input to text string buffer 102 and stored there.

Text string buffer 102 outputs a text string on a request from standard speech-synthesis length calculating unit 103, control unit 104, and speech synthesizing unit 106. When a new text string is input from text information input unit 101 and stored in text string buffer 102, text string buffer 102 issues an update notification signal to standard speech-synthesis length calculating unit 103.

Standard speech-synthesis length calculating unit 103, when detecting from an update notification signal that a new text string has been stored in text string buffer 102, issues a readout request to text string buffer 102. Then, standard speech-synthesis length calculating unit 103 reads a text string stored, from text string buffer 102. When speech synthesizing unit 106 speech-synthesizes a text string having been read, at a given speed (described as "standard speed" hereinafter), standard speech-synthesis length calculating unit 103 calculates time required to pronounce the speech. Then, standard speech-synthesis length calculating unit 103 outputs a readout duration signal representing time to pronounce calculated, to control unit 104 according to the result. Here, the standard speed is a standard speed as represented by that pronounced by an announcer for instance.

Control unit 104 calculates a readout speed ratio on the basis of a readout duration signal input from standard speech-synthesis length calculating unit 103 and of time information retained in control unit memory 105. Then, control unit 104 outputs a readout speed ratio signal to speech synthesizing unit 106 on the basis of the calculation result. Control unit 104 outputs time information on a text string stored in text string buffer 102 to control unit memory 105.

Speech synthesizing unit 106 issues a readout request to text string buffer 102. Speech synthesizing unit 106 speech-synthesizes a text string input from text string buffer 102 on the basis of a readout speed ratio represented by a readout speed ratio signal calculated by control unit 104. Then, speech synthesizing unit 106 outputs an audio signal having undergone speech synthesis to audio output unit 107.

Next, an example is shown of the data structure of time information and a text string stored in text string buffer 102 using FIG. 2. FIG. 2 schematically shows the data structure of time information and a text string stored in text string buffer 102 according to the embodiment. In the example, text string buffer 102 is implemented by software with description as a data structure named as "strbuff" and "stringFIFO". In the example, text string buffer 102 stores time information that is the time when a text string has been input to text string buffer 102, in the variable "time". Text string buffer 102 stores up to five text strings, in the variable "str" and in the variable "buff" (details are described later). Text string buffer 102 further stores the last data position of the text strings stored, in the variable "laststr".

In the example, the variable "str" storing a text string can store a maximum of 256 characters; however, more than that provides the same effect. Meanwhile, even if the text string length ensured is changed according to the length of a text string input, the same effect is provided. In the example, "int64" is 64-bit integer type; "char", 8-bit character type; "int", 32-bit integer type. However, the other numbers of bits and the other types provide the same effect. In the embodiment, text string buffer 102 is implemented with software description defining operation of hardware such as a CPU and memory. Although text string buffer 102 can be implemented with only hardware, software enables various types of settings to be changed flexibly, and additionally text string buffer 102 can be implemented at low cost.

Next, an example is shown of data stored in the data structure of FIG. 2 using FIG. 3. Text string buffers 1, 2, 3, 4, 5 respectively correspond to buff[0], buff[1], buff[2], buff[3], and buff[4] that are variables in the data structure of FIG. 2. Each buff contains time information 301 and stored text string 302. For instance, time information 301 contained in text string buffer 1 can be represented as "strfifo.buff[0].time". Stored text string 302 contained in text string buffer 1 can be represented as "strfifo.buff[0].str".

Time information 301 in the embodiment is assumed to contain the coordinated universal time (UTC), which is used in general computer languages, representing elapsed seconds from 00:00:00, Jan. 1, 1970. Only hour, minute, and second are shown in FIG. 3; actually year and month are assumed to be included. Here, the embodiment provides the same effect if time information 301 contains data represented by another method.

The data contained in last data position 303 shown in FIG. 3 represents the position of the last data in text string buffer 102 containing currently valid data. In the state of FIG. 3 for instance, assumption is made that text string buffers 1, 2, 3 contain valid data; and that text string buffers 4, 5 contain null or invalid data. Hence, the data contained in last data position 303 indicates text string buffer 3 that contains the last data out of valid data. In FIG. 3, last data position 303 corresponds to variable "laststr" in the example of the data structure of FIG. 2. Time information 301 contained in text string buffers 1 through 5 is associated with stored text string 302, which is assumed to store a time point when stored text string 302 is input to text string buffer 102 as time information 301.

Next, a concrete description is made of operation of text string buffer 102. For instance, assumption is made in the state of data storage in FIG. 3 as follows. That is, the text string "12:00:10" has been input as time information 301; and the text string "TOMORROW'S FORECAST IS SUNNY IN ALL THE AREA", as stored text string 302. In this case, the text string "12:00:10" is stored in time information 301 of text string buffer 4 that is the next empty text string buffer; and the text string "TOMORROW'S FORECAST IS SUNNY IN ALL THE AREA" is stored in text string 302 of text string buffer 4. Then, last data position 303 is changed so as to indicate text string buffer 4.

In the state of data storage shown in FIG. 3, when a direction is made to delete one text string buffer, the data stored in text string buffer 2 is copied to text string buffer 1. Then, the data stored in text string buffer 3 is copied to text string buffer 2. Further, the data stored in text string buffer 4 is copied to text string buffer 3. Still, the data stored in text string buffer 5 is copied to text string buffer 4. Then, last data position 303 is changed so as to indicate the next upper text string buffer (i.e. text string buffer 2 in the state of data storage shown in FIG. 3).

As described above, in the embodiment, data is assumed to be always deleted from text string buffer 1. Then, subsequent data is assumed to be shifted while copying text string buffer 2 into text string buffer 1; and text string buffer 3 into text string buffer 2. Alternatively, in addition to the elements of the data structure, a variable indicating a start data position may be added, where the start data position indicates data to be deleted. Specifically, to delete data, the start data position is changed so as to indicate text string buffer 2 when the start data position currently indicates text string buffer 1 for instance; to indicate text string buffer 3 when the start data position currently indicates text string buffer 2. This method increases the process speed while providing the same effect.

In this embodiment, up to five text string buffers are assumed to be provided. However, the same effect is provided with the number of text string buffers larger or smaller than that, or changed dynamically.

Hereinafter, a detailed description is made of operation of the text information presentation device according to the embodiment using FIG. 1. As shown in FIG. 1, text string buffer 102 outputs data stored according to a request from standard speech-synthesis length calculating unit 103, control unit 104, and speech synthesizing unit 106. Further, as described above, control unit 104 outputs time information on a text string stored in text string buffer 102, to control unit memory 105. In this way, time information stored in control unit memory 105 as a memory is updated to time information on a text string read from text string buffer 102 when control unit 104 calculates a readout speed ratio signal.

Further, data is deleted on the basis of a data delete request issued from speech synthesizing unit 106 to text string buffer 102 when speech synthesizing unit 106 reads data from text string buffer 102. When text information input unit 101 inputs a text string into text string buffer 102, text string buffer 102 issues an update notification signal representing that data stored has been updated, to standard speech-synthesis length calculating unit 103, control unit 104, and speech synthesizing unit 106.

Figure 4:
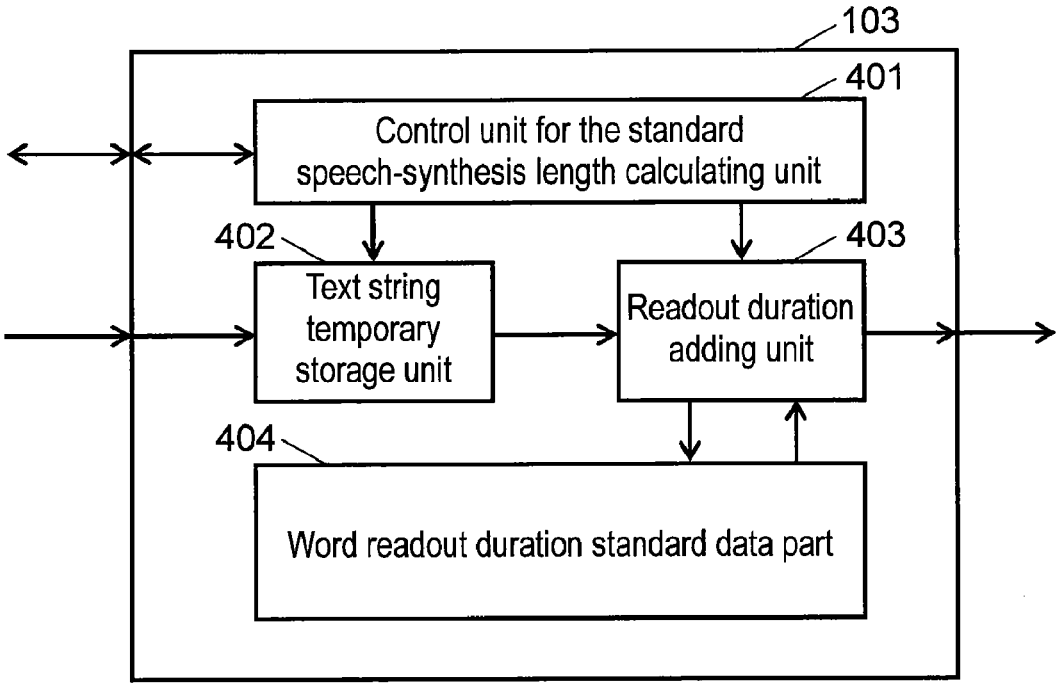
FIG. 4 is a block diagram showing an internal configuration of the standard speech-synthesis length calculating unit according to the first embodiment of the present invention.

Standard speech-synthesis length calculating unit 103 in FIG. 1 calculates time required for speech synthesizing unit 106 to pronounce a text string in text string buffer 102 at the standard speed. FIG. 4 is a block diagram showing an internal configuration of standard speech-synthesis length calculating unit 103. Standard speech-synthesis length calculating unit 103 includes control unit 401 for the standard speech-synthesis length calculating unit, text string temporary storage unit 402, readout duration adding unit 403, and word readout duration standard data part 404.

Next, a description is made of operation of standard speech-synthesis length calculating unit 103 thus configured. Control unit 401 for the standard speech-synthesis length calculating unit, when receiving an update notification signal from text string buffer 102, outputs a readout request to read text string data updated, to text string buffer 102. Then, control unit 401 for the standard speech-synthesis length calculating unit sets the readout duration stored in readout duration adding unit 403 to 0. Text string buffer 102 outputs the text string updated, to standard speech-synthesis length calculating unit 103, and standard speech-synthesis length calculating unit 103 stores the text string input, in text string temporary storage unit 402. Text string temporary storage unit 402 divides a text string stored, into words and outputs them to readout duration adding unit 403, according to a request from control unit 401 for the standard speech-synthesis length calculating unit.

Readout duration adding unit 403 refers a word-unit text string input from text string temporary storage unit 402, to word readout duration standard data part 404, and calculates time required for speech synthesizing unit 106 to pronounce the relevant words at the standard speed. On the basis of the result, readout duration adding unit 403 adds the time calculated, to the readout duration stored in readout duration adding unit 403. Readout duration adding unit 403 thus operates all the words of a text string stored in text string temporary storage unit 402 to calculate a readout duration of the text string.

Next, control unit 401 for the standard speech-synthesis length calculating unit, after readout duration of a text string is calculated, issues an output request for a readout duration, to readout duration adding unit 403. Then, readout duration adding unit 403 outputs a readout duration signal containing a readout duration on the basis of the output request. The readout duration signal output is input to control unit 104.

Next, an example is shown of data stored in word readout duration standard data part 404 using FIG. 5. As an example of data, the column of word 501 (described as "word501" in FIG. 5); and the column of readout duration 502 (described as "duration502" in FIG. 5) that is time required to pronounce word 501 at the standard speed are shown.

Association and correspondence are made between word501 and duration502. For instance, duration502 corresponding to word501 of "cloudy" is 2.0. The unit of duration502 is assumed to be second in the embodiment, where for instance, time required to pronounce "cloudy" is 2.0 seconds in the table of FIG. 5. Using the other unit provides the same effect.

Meanwhile, control unit 401 for the standard speech-synthesis length calculating unit, when receiving a data update notice from text string buffer 102, issues a readout request to read a text string data updated, to text string buffer 102. Then, when the text string "NEXT IS WEATHER FORCAST" is output from text string buffer 102, the text string is first retained in text string temporary storage unit 402. Then, control unit 401 for the standard speech-synthesis length calculating unit sets the readout duration stored in readout duration adding unit 403 to 0. Text string temporary storage unit 402 divides a text string stored in a word unit according to a request from control unit 401 for the standard speech-synthesis length calculating unit. Then, text string temporary storage unit 402 outputs the text string to readout duration adding unit 403 in a word unit. Specifically, output is performed in a word unit: the text strings "NEXT", "IS", "WEATHER", and "FORCAST". Readout duration adding unit 403 refers word-unit text string data output from text string temporary storage unit 402, to word readout duration standard data part 404. Then, readout duration adding unit 403 continues adding duration502 in FIG. 5 corresponding to each word, to the readout duration. In the example, duration502 in FIG. 5 corresponding to each word is 1.5 seconds for the text string "NEXT"; 1.0 second, for "IS"; 2.0 seconds for "WEATHER"; and 2.5 seconds for "FORCAST", and the sum is 7.0 seconds for only words Here, readout duration adding unit 403 handles such as a space character, period, and comma inserted between words in the same way. For instance, if 0.5 second is respectively allocated to a space character, period, and comma, the text string "NEXT IS WEATHER FORCAST" has three space characters inserted therein, and thus 1.5 seconds are added. Consequently, the readout duration of the text string "NEXT IS WEATHER FORCAST" is 8.5 seconds after all the words, space characters, period, and comma are processed. Readout duration adding unit 403 outputs a readout duration signal containing the readout duration calculated, to control unit 104.

When a time period for enhancing recognizability of each word has been already added to duration502 in word readout duration standard data part 404, separately adding time periods for space characters is not needed. In the embodiment, such as a space, period, and comma used in English are instanced. For other languages, handling punctuation marks used in each language in the same way provides the same effect.

In the embodiment, an example is shown where only 16 words are stored in word readout duration standard data part 404. Actually, however, words commonly used in the language pronounced are desirably contained in word readout duration standard data part 404.

Here, with readout duration standard data part 404 supporting not only one language but plural languages provided, multilingualization can be supported. When supporting plural languages, data efficiency can be further improved by the following way. That is, one word readout duration standard data part 404 may store data in plural languages to improve data efficiency. As another way, plural word readout duration standard data parts 404 may be provided for each language. As yet another way, words common to each language are stored in one word readout duration standard data part 404, and words specific to each language are stored in another word readout duration standard data part 404 provided.

Here, when a word not present in word readout duration standard data part 404 is referred to, word readout duration standard data part 404 is assumed to output a readout duration by the next methods. That is, when a word not present in word readout duration standard data part 404 is referred to, word readout duration standard data part 404 outputs a readout duration such as by calculating a readout duration according to the number of characters of a corresponding word; or by determining a readout duration by that of a similar word.

Here, when a word not present in word readout duration standard data part 404 is referred to, word readout duration standard data part 404 can output a readout duration by further dividing a word and providing tables for each divided unit. For instance, the word "implementation" can be divided into the text strings "im", "ple", "men", and "tation". Then, if time required to pronounce is stored in word readout duration standard data part 404 for each divided element, the time required pronouncing each element can be added even if word readout duration standard data part 404 is not present for each word. Consequently, the time required to actually pronounce in a word unit can be calculated.

The same effect is provided if time required to pronounce each divided element of words, instead of each word, is retained in word readout duration standard data part 404.

Here, besides providing a database for calculating the readout duration of words in word readout duration standard data part 404 as in the embodiment, using an algorithm for calculating the readout duration of words from a text string on the basis of a language-pronouncing rule provides the same effect.

Next, a description is made of time information 601 stored in control unit memory 105 using FIG. 6 and of the calculating process in control unit 104. As an example, FIG. 6 shows that the text string "12:00:00" as time information is stored in time information 601. In the example, a description is made for a state after control unit 104 has processed the text string "12:00:00" (i.e. time information 301) and the text string "NEXT IS WEATHER FORCAST" (i.e. stored text string 302) that have been stored in text string buffer 1 shown in FIG. 3. Control unit 104, when receiving a readout duration signal from standard speech-synthesis length calculating unit 103, reads time information 301 and stored text string 302, from text string buffer 102. Control unit 104, when processing the text string "12:00:03" (i.e. time information 301) and the text string "WEATHER IS FINE IN THE NORTHERN AREA" (i.e. stored text string 302) as calculation-target data, first calculates time required for speech synthesizing unit 106 to pronounce the text string "WEATHER IS FINE IN THE NORTHERN AREA" at the standard speed in standard speech-synthesis length calculating unit 103.

For this calculation, a readout duration signal output from standard speech-synthesis length calculating unit 103 can be used. Instead, control unit 104 may calculate a readout duration using the table of FIG. 5. The result shows pronouncing only words requires 10.5 seconds. If six space characters between each word require 0.5 seconds each, time to pronounce the text string at the standard speed requires another 3 seconds. Hence, time required for speech synthesizing unit 106 to pronounce the text string "WEATHER IS FINE IN THE NORTHERN AREA" at the standard speed is determined as 13.5 seconds.

Next, control unit 104 reads the text string "12:00:00" (i.e. time information 601 stored in control unit memory 105) and determines the time difference from the text string "12:00:03" (i.e. time information 301 of calculation-target data). In this case, the time difference calculated is 3 seconds. Then, control unit 104 calculates a readout speed ratio required to complete pronouncing the text string "WEATHER IS FINE IN THE NORTHERN AREA" that requires 13.5 seconds for speech synthesizing unit 106 to pronounce at the standard speed, in 3 seconds (the time difference calculated). The next formula provides a readout speed ratio (e.g. 100 when pronounced at the standard speed). That is, (readout speed ratio) =(time required when pronounced at the standard speed)/(time difference)*100.

In the example, the above-described formula provides a readout speed ratio of 13.5/3*100=450. Control unit 104 outputs the value (450 here) as a readout speed ratio signal representing the readout speed ratio, to speech synthesizing unit 106. Then, control unit 104 updates time information 601 stored in control unit memory 105 to the text string "12:00:03" (i.e. time information 301 stored in text string buffer 2).

Speech synthesizing unit 106, when receiving a readout speed ratio signal from control unit 104, reads a text string from text string buffer 102, to read out the text string at the readout speed ratio represented by the readout speed ratio signal received. The speed of pronouncing a speech synthesized by speech synthesizing unit 106 is equal to the standard speed calculated by standard speech-synthesis length calculating unit 103 when the readout speed ratio output from control unit 104 is 100, and varies proportionally to the readout speed ratio output from control unit 104. For instance, when the readout speed ratio output from control unit 104 is 200, a speech is pronounced at a speed twice the standard speed calculated by standard speech-synthesis length calculating unit 103. Consequently, time required to pronounce is half. On the other hand, when the readout speed ratio output from control unit 104 is 50, a speech is pronounced at a speed half the standard speed calculated by standard speech-synthesis length calculating unit 103. Consequently, time required to pronounce is twice.

Here, in the embodiment, time information 301 in text string buffer 102 is associated with stored text string 302. More specifically, text string buffer 102 stores the time point when a text string has been input from text information input unit 101 to text string buffer 102, as time information 301. However, when time information, along with a text string, has been input from text information input unit 101, the same effect is provided if the time information input along with the text string is to be stored in text string buffer 102, instead of the time point when the text string is input to text string buffer 102 by text information input unit 101. In other words, time information on a text string stored in controller memory 105 as a memory may be presentation time information associated with a text string input from text information input unit 101. In subtitle information used in TV broadcasting, for instance, time information representing a time of day displayed on a screen is sent along with text strings. As a result that the time of day displayed on the screen is stored and used as time information 301 in text string buffer 102, speech synthesis more suitable for subtitles can be performed.

Here, in the embodiment, control unit 104 controls the pronouncing speed of a speech synthesized by speech synthesizing unit 106, using the standard speed calculated by standard speech-synthesis length calculating unit 103. However, simply using the number of characters or words of a text string pronounced provides the same effect even if control unit 104 controls the pronouncing speed of a speech synthesized by speech synthesizing unit 106.

Specifically, in calculating by the number of characters, the text string "WEATHER IS FINE IN THE NORTHERN AREA" in the example, for instance, the number of characters is 36 including space characters. Control unit 104 may calculate a readout speed ratio by the formula: (the number of characters)*10 on the basis of the number of characters, for instance. Then, control unit 104 outputs 360 (the calculation result) as a readout speed ratio to speech synthesizing unit 106. Control unit 104 may thus calculate a readout speed ratio on the basis of the number of characters of a text string stored in text string buffer 102.

Meanwhile, in calculating by the number of words, the text string "WEATHER IS FINE IN THE NORTHERN AREA" in the example, for instance, the number of words is 6. Control unit 104 may calculate a readout speed ratio by the formula: (the number of words)*80 on the basis of the number of words, for instance. Then, control unit 104 outputs 480 (the calculation result) as a readout speed ratio to speech synthesizing unit 106. Control unit 104 may thus calculate a readout speed ratio on the basis of the number of words of a text string stored in text string buffer 102.

As described above, the text information presentation device of the embodiment includes: control unit memory 105 as a memory storing time information on a text string; text information input unit 101 accepting input of a text string; text string buffer 102 storing a text string input to text information input unit 101 and outputting an update notification signal; and standard speech-synthesis length calculating unit 103 that reads a text string stored in text string buffer 102 when receiving an update notification signal, and calculates a duration required if the text string is pronounced at a given speed to output a readout duration signal. The text information presentation device further includes: control unit 104 that calculates a readout speed ratio on the basis of a readout duration signal output from standard speech-synthesis length calculating unit 103, time information on a text string stored in text string buffer 102 corresponding to the readout duration signal, and time information on a text string stored in the memory, and output a readout speed ratio signal; and speech synthesizing unit 106 issuing a readout request to text string buffer 102, and speech-synthesizing a text string input from text string buffer 102 on the basis of the readout speed ratio signal.

With such a configuration, control unit 104 calculates a readout speed ratio by using the above-described formula with the following two factors. One is a readout duration contained in a readout duration signal that represents time required to pronounce a text string at the standard speed. The other is the interval between time information on a text string stored in text string buffer 102 and that stored in the memory (i.e. the time interval between time points when a text string is input), namely the time difference between each time information.

The speed of speech synthesis is thus calculated, and speech synthesizing unit 106 can present text information on the basis of the readout speed calculated. Further, control unit 104 can calculate the speed of speech synthesis using time required for speech synthesis and the interval between time information on a text string input along with text strings. Hence, a text information presentation device can be provided that sets the text string readout speed to an optimum value to ensure audibility even if the frequency of text strings arriving and the number of the characters are not known preliminarily.

Second Exemplary Embodiment

Figure 7:
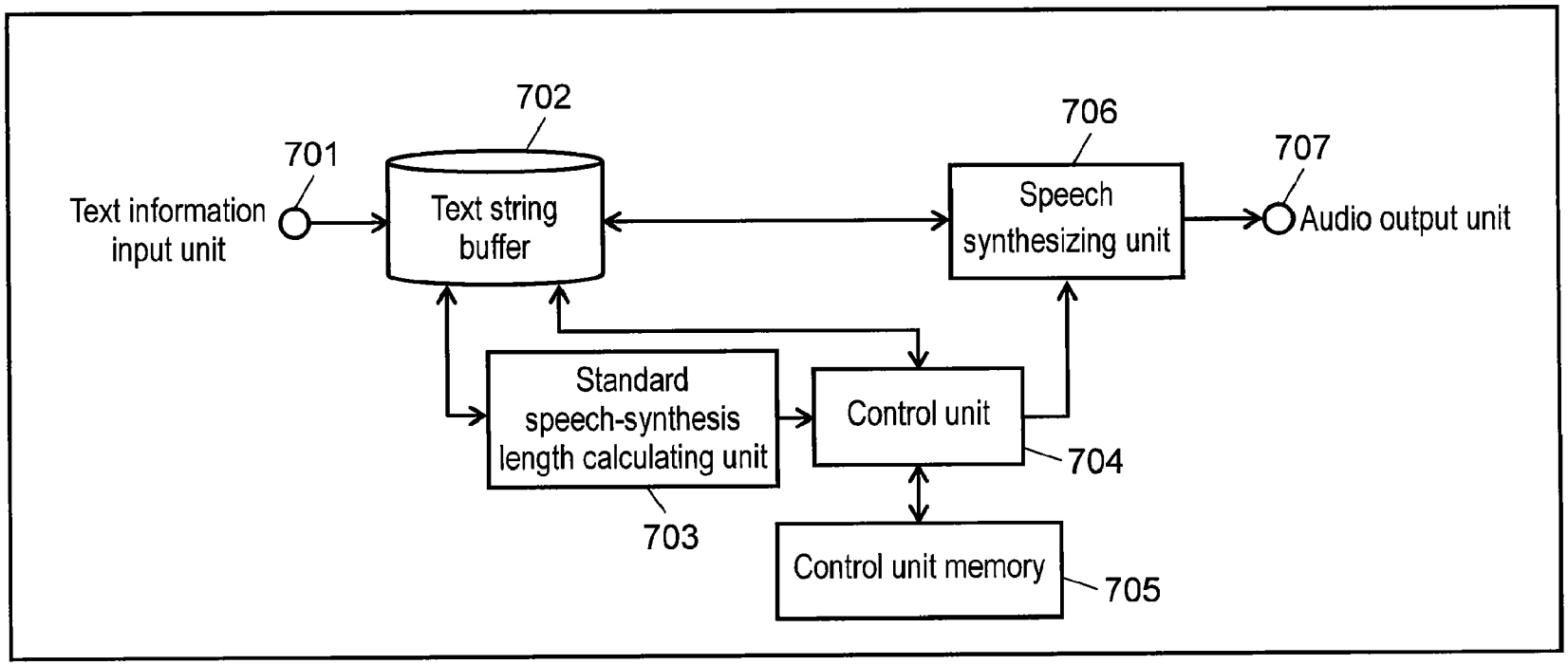
FIG. 7 is a block diagram showing a configuration of the text information presentation device according to the second exemplary embodiment of the present invention.

FIG. 7 is a block diagram showing a configuration of a text information presentation device according to the second exemplary embodiment of the present invention. As shown in FIG. 7, the text information presentation device according to the embodiment includes text information input unit 701, text string buffer 702, standard speech-synthesis length calculating unit 703, control unit 704, control unit memory 705 as a memory storing time information on a text string, speech synthesizing unit 706, and audio output unit 707. Text information input unit 101 of the text information presentation device according to the first embodiment accepts input of a text string. Meanwhile, text information input unit 701 of the text information presentation device according to this embodiment accepts input of a text string, presentation time information, and erasing time information, which is different from that of the first embodiment.

Next, a description is made of operation of the text information presentation device according to the embodiment thus configured. A text string, presentation time information, and erasing time information input from text information input unit 701 are input to text string buffer 702 and stored there.

Text string buffer 702 outputs a text string, presentation time information, and erasing time information on a request from standard speech-synthesis length calculating unit 703, control unit 704, and speech synthesizing unit 706. When a new text string is input from text information input unit 701 and stored in text string buffer 702, text string buffer 702 issues an update notification signal to standard speech-synthesis length calculating unit 703.

Each operation of standard speech-synthesis length calculating unit 703, control unit 704, and speech synthesizing unit 706 is respectively the same as that of standard speech-synthesis length calculating unit 103, control unit 104, and speech synthesizing unit 106 according to the first embodiment shown in FIG. 1, and thus their descriptions are omitted. Each of their detailed operation is separately described later.

Next, an example is shown of the data structure of time information, erasing time information, and a text string stored in text string buffer 702 using FIG. 8. FIG. 8 schematically shows an example of the data structure of time information, erasing time information, and a text string stored in text string buffer 702 according to the embodiment. In the example, text string buffer 702 is implemented by software with description as a data structure named as "strbuff" and "stringFIFO". In the example, text string buffer 702 stores display start time of up to five text strings, display end time of them, and the text strings in the variables "display_time", "erase_time", and "str". The position of the last data of the text strings stored is stored in the variable "laststr".

In the example, the variable "str" for storing text strings is assumed to contain a maximum of 256 characters. However, more than that provides the same effect. Alternatively, even if the text string length ensured is changed according to the length of a text string input, the same effect is provided. In the example, "int64" is of 64-bit integer type; char, 8-bit character type; "int", 32-bit integer type. However, the other numbers of bits and the other types provide the same effect. In the embodiment as well, text string buffer 702 is implemented with software description defining operation of hardware such as a CPU and memory. Although text string buffer 702 can be implemented with only hardware, software enables various types of settings to be changed flexibly, and additionally text string buffer 702 can be implemented at low cost.

Next, an example is shown of data stored in the data structure of FIG. 8 using FIG. 9. Text string buffers 1, 2, 3, 4, 5 respectively correspond to buff[0], buff[1], buff[2], buff[3], and buff[4] that are variables in the data structure of FIG. 8. Each buff contains presentation time information 901, erasing time information 902, and stored text string 903. For instance, presentation time information 901 contained in text string buffer 1 can be represented as "strfifo.buff[0].time".

Erasing time information 902 contained in text string buffer 1 can be represented as "strfifo.buff[0].erase_time". Text string 903 stored in text string buffer 1 can be represented as "strfifo.buff[0].str".

Presentation time information 901 and erasing time information 902 in the embodiment are assumed to contain the coordinated universal time (UTC), which is used in general computer languages, representing elapsed seconds from 00:00:00, Jan. 1, 1970. Only hour, minute, and second are shown in FIG. 9; actually year and month are assumed to be included. Here, the embodiment provides the same effect if presentation time information 901 and erasing time information 902 are stored by another method.

The data contained in last data position 904 shown in FIG. 9 represents the position of the last data in text string buffer 702 containing currently valid data. In the state of FIG. 9 for instance, assumption is made that text string buffers 1, 2, 3 contain valid data; and that text string buffers 4, 5 contain null or invalid data. Hence, the data contained in last data position 904 indicates text string buffer 3 that contains the last data out of valid data. In FIG. 9, last data position 904 corresponds to the variable "laststr" in the example of the data structure of FIG. 8. A text string, presentation time information, and erasing time information input from text information input unit 701 are input to text string buffer 702, and stored in stored text string 903, presentation time information 901, and erasing time information 902 each corresponding. As shown in FIG. 9, presentation time information 901 and erasing time information 902 stored in text string buffers 1 through 5 are associated with stored text string 903.

Next, a description is made of concrete operation of text string buffer 702. For instance, assumption is made in the state of data storage in FIG. 9 as follows. That is, the text string "12:00:10" has been input as presentation time information 901; the text string "12:00:13", as erasing time information 902; and the text string "TOMORROW'S FORECAST IS SUNNY IN ALL THE AREA", as stored text string 903. In this case, the text string "12:00:10" is stored in presentation time information 901 of text string buffer 4 that is the next empty text string buffer; the text string "12:00:13", in erasing time information 902 of text string buffer 4; and the text string "TOMORROW'S FORECAST IS SUNNY IN ALL THE AREA", in stored text string 903 of text string buffer 4. Then, last data position 904 is changed so as to indicate text string buffer 4.

In the state of data storage shown in FIG. 9, when a direction is made to delete one text string buffer, the data stored in text string buffer 2 is copied to text string buffer 1. Then, the data stored in text string buffer 3 is copied to text string buffer 2. Further, the data stored in text string buffer 4 is copied to text string buffer 3. Still, the data stored in text string buffer 5 is copied to text string buffer 4. Then, last data position 904 is changed so as to indicate the next upper text string buffer (i.e. text string buffer 2 in the state of data storage shown in FIG. 9).

As described above, data is assumed to be always deleted from text string buffer 1 in the embodiment. Then, subsequent data is assumed to be shifted while copying text string buffer 2 to text string buffer 1; and text string buffer 3 to text string buffer 2. Alternatively, in addition to the elements of the data structure, a variable indicating a start data position may be added, where the start data position indicates data to be deleted. Specifically, when data has been deleted, the start data position is changed so as to indicate text string buffer 2 when the start data position currently indicates text string buffer 1 for instance. The start data position may be changed so as to indicate text string buffer 3 when the start data position currently indicates text string buffer 2. This method increases the process speed while providing the same effect.

In this embodiment, up to five text string buffers are assumed to be provided. However, the same effect is provided with the number of text string buffers larger or smaller than that, or changed dynamically.

Hereinafter, a description is made of detailed operation of the text information presentation device according to the embodiment using FIG. 7. As shown in FIG. 7, text string buffer 702 outputs data stored according to a request from standard speech-synthesis length calculating unit 703, control unit 704, and speech synthesizing unit 706.

Meanwhile, data is deleted on the basis of a data delete request issued from speech synthesizing unit 706 to text string buffer 702 when speech synthesizing unit 706 reads data from text string buffer 702. When text information input unit 701 inputs a text string to text string buffer 702, text string buffer 702 issues an update notification signal representing that data stored has been updated, to standard speech-synthesis length calculating unit 703, control unit 704, and speech synthesizing unit 706.

Figures 10, 11:
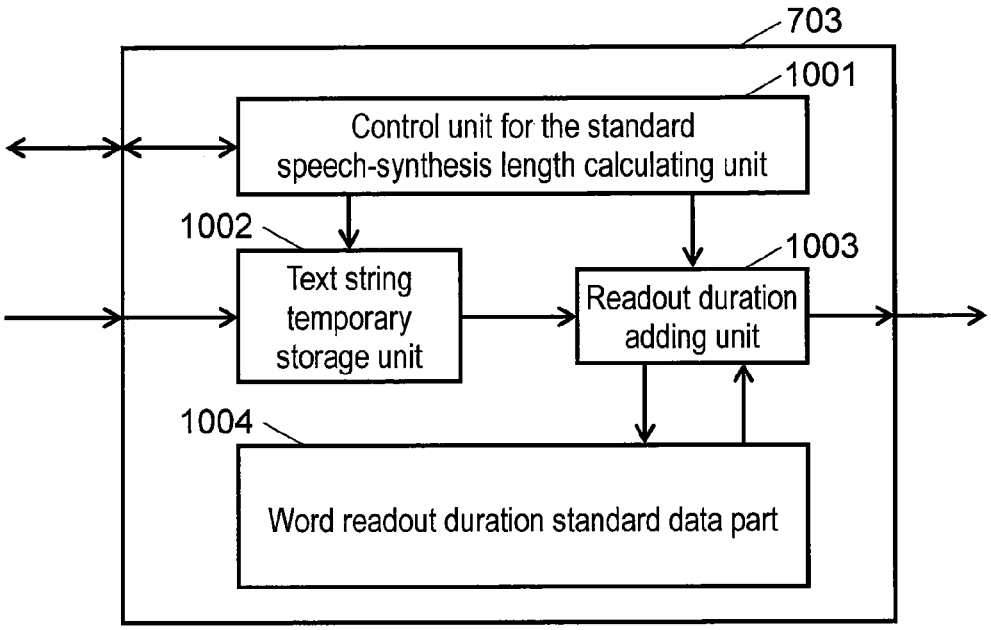
FIG. 10 is a block diagram showing an internal configuration of the standard speech-synthesis length calculating unit according to the second embodiment of the present invention.
FIG. 11 schematically shows an example of data stored in the word readout duration standard data part according to the second embodiment of the present invention.

Standard speech-synthesis length calculating unit 703 in FIG. 7 calculates time required for speech synthesizing unit 706 to pronounce a text string in text string buffer 702 at the standard speed. FIG. 10 is a block diagram showing an internal configuration of standard speech-synthesis length calculating unit 703. Standard speech-synthesis length calculating unit 703 includes control unit 1001 for the standard speech-synthesis length calculating unit, text string temporary storage unit 1002, readout duration adding unit 1003, and word readout duration standard data part 1004.

Next, a description is made of operation of standard speech-synthesis length calculating unit 703 thus configured. Here, operations of control unit 1001 for the standard speech-synthesis length calculating unit, text string temporary storage unit 1002, readout duration adding unit 1003, and word readout duration standard data part 1004 included in standard speech-synthesis length calculating unit 703 are respectively the same as those of control unit 401 for the standard speech-synthesis length calculating unit, text string temporary storage unit 402, readout duration adding unit 403, and word readout duration standard data part 404 included in standard speech-synthesis length calculating unit 103 according to the first embodiment shown in FIG. 4, and thus their descriptions are omitted.

Next, an example is shown of data stored in word readout duration standard data part 1004 using FIG. 11. As an example of data, the column of word 1101 (described as "word1101" in FIG. 11); and the column of readout duration 1102 (described as "duration1102" in FIG. 11) that is time required to pronounce word 1101 at the standard speed are shown.

Association and correspondence are made between word1101 and duration1102. For instance, duration1102 corresponding to word1101 of "cloudy" is 2.0. The unit of duration1102 is assumed to be second in the embodiment, where for instance, time required to pronounce "cloudy" is 2.0 seconds in the table of FIG. 11. Using the other unit provides the same effect.

Meanwhile, control unit 1001 for the standard speech-synthesis length calculating unit, when receiving a data update notice from text string buffer 702, issues a readout request to read a text string data updated, to text string buffer 702. Then, when the text string "NEXT IS WEATHER FORCAST" is output from text string buffer 702, the text string is first retained in text string temporary storage unit 1002. Then, control unit 1001 for the standard speech-synthesis length calculating unit sets the readout duration stored in readout duration adding unit 1003 to 0. Text string temporary storage unit 1002 divides the text string stored in a word unit according to a request from control unit 1001 for the standard speech-synthesis length calculating unit. Then, text string temporary storage unit 1002 outputs the text string in a word unit to readout duration adding unit 1003. Specifically, output is performed in a word unit: the text strings "NEXT", "IS", "WEATHER", and "FORCAST". Readout duration adding unit 1003 refers word-unit text string data output from text string temporary storage unit 1002 to word readout duration standard data part 1004. Then, readout duration adding unit 1003 continues adding duration1102 in FIG. 11 corresponding to each word to the readout duration. In the example, duration1102 in FIG. 11 corresponding to each word is 1.5 seconds for the text string "NEXT"; 1.0 second, for "IS"; 2.0 seconds for "WEATHER"; and 2.5 seconds for "FORCAST", and the sum is 7.0 seconds for only words Here, readout duration adding unit 1003 handles such as a space character, period, and comma inserted between words in the same way. For instance, if 0.5 second is respectively allocated to a space character, period, and comma, the text string "NEXT IS WEATHER FORCAST" has three space characters inserted therein, and thus 1.5 seconds are added. Consequently, the readout duration of the text string "NEXT IS WEATHER FORCAST" is 8.5 seconds after all the words, space characters, period, and comma are processed. Readout duration adding unit 1003 outputs a readout duration signal calculated to control unit 704.

When a time period for enhancing recognizability of each word has been already added to duration1102 in word readout duration standard data part 1004, separately adding time for space characters is not needed. In the embodiment, such as a space, period, and comma used in English are instanced. For other languages, handling punctuation marks used in each language in the same way provides the same effect.

In the embodiment, the example is shown where only 16 words are stored in the word readout duration standard data part. Actually, however, generally used words in the language pronounced are desirably contained in word readout duration standard data part 1004.

Here, with readout duration standard data part 1004 supporting not only one language but plural languages provided, multilingualization can be supported. When supporting plural languages, data efficiency can be further improved by the following way. That is, to improve data efficiency, one word readout duration standard data part 1004 may store data in plural languages. As another way, plural word readout duration standard data parts 1004 may be provided for each language. As yet another way, words common to each language are stored in one word readout duration standard data part 1004, and words specific to each language are stored in another word readout duration standard data part 1004 provided.

Here, when a word not present in word readout duration standard data part 1004 is referred to, word readout duration standard data part 1004 is assumed to output a readout duration by the next method. That is, word readout duration standard data part 1004 outputs a readout duration such as by calculating a readout duration according to the number of characters of the corresponding word; and by determining a readout duration by that of a similar word.

Here, when a word not present in word readout duration standard data part 1004 is referred to, word readout duration standard data part 1004 can output a readout duration by further dividing the word and providing tables for each divided unit. For instance, the word "implementation" can be divided into the text strings "im", "ple", "men", and "tation". Then, if time required to pronounce is preliminarily stored in word readout duration standard data part 1004 for each divided element, the time required to pronounce each element can be added even if word readout duration standard data part 1004 is not present for each word. Consequently, time required to actually pronounce in a word unit can be calculated.

The same effect is provided if time required to pronounce each divided element of words, instead of each word, is retained in word readout duration standard data part 1004.

Here, besides providing a database for calculating the readout duration of words in word readout duration standard data part 1004 as in the embodiment, the same effect is provided by using an algorithm for calculating the readout duration of words from a text string on the basis of a language-pronouncing rule.

Next, a description is made of the calculating process in control unit 704 using FIG. 9. In the example, a description is made for a case where control unit 704 has processed the text string "12:00:03" (i.e. presentation time information 901); the text string "12:00:06" (i.e. erasing time information 902); and the text string "WEATHER IS FINE IN THE NORTHERN AREA" (i.e. stored text string 903), stored in text string buffer 2 shown in FIG. 9. Control unit 704, when receiving a readout duration signal from standard speech-synthesis length calculating unit 703, reads presentation time information 901 and stored text string 903 from text string buffer 702. When control unit 704 processes the text string "12:00:03" (i.e. presentation time information 901); the text string "12:00:06" (i.e. erasing time information 902); and the text string "WEATHER IS FINE IN THE NORTHERN AREA" (i.e. stored text string 903) as calculation-target data, standard speech-synthesis length calculating unit 703 first calculates time required for speech synthesizing unit 706 to pronounce the text string "WEATHER IS FINE IN THE NORTHERN AREA" at the standard speed.

For this calculation, a readout duration signal output from standard speech-synthesis length calculating unit 703 can be used. Instead, control unit 704 may calculate a readout duration using the table of FIG. 11. The result shows pronouncing only words requires 10.5 seconds. If six space characters between each word require 0.5 seconds each, time to pronounce the text string at the standard speed requires another 3 seconds. Hence, time required for speech synthesizing unit 706 to pronounce the text string "WEATHER IS FINE IN THE NORTHERN AREA" at the standard speed is determined as 13.5 seconds.

Next, control unit 704 determines the time difference between the text string "12:00:03" (i.e. presentation time information 901) and the text string "12:00:06" (i.e. erasing time information 902) stored in text string buffer 2. In this case, the time difference calculated is 3 seconds. Then, control unit 104 calculates a readout speed ratio required to complete pronouncing the text string "WEATHER IS FINE IN THE NORTHERN AREA" that requires 13.5 seconds to pronounce at the standard speed, in 3 seconds (the time difference calculated). The next formula provides a readout speed ratio (e.g. 100 when pronounced at the standard speed). That is, (readout speed ratio)=(time required when pronounced at the standard speed)/(time difference)*100.

In the example, the above-described formula provides a readout speed ratio of 13.5/3*100=450. Control unit 704 outputs the value (450 here) as a readout speed ratio signal representing the readout speed ratio, to speech synthesizing unit 706.

Speech synthesizing unit 706, when receiving a readout speed ratio signal from control unit 704, reads a text string from text string buffer 702 to read out the text string at the readout speed ratio represented by the readout speed ratio signal received. The speed of pronouncing a speech synthesized by speech synthesizing unit 706 is equal to the standard speed calculated by standard speech-synthesis length calculating unit 703 when the readout speed ratio output from control unit 704 is 100, and varies proportionally to the readout speed ratio output from control unit 704. For instance, when the readout speed ratio output from control unit 704 is 200, a speech is pronounced at a speed twice the standard speed calculated by standard speech-synthesis length calculating unit 703. Consequently, time required to pronounce is half. On the other hand, when the readout speed ratio output from control unit 704 is 50, a speech is pronounced at a speed half the standard speed calculated by standard speech-synthesis length calculating unit 703. Consequently, time required to pronounce is twice.

Here, in the embodiment, control unit 704 controls the pronouncing speed of a speech synthesized by speech synthesizing unit 706, using the standard speed calculated by standard speech-synthesis length calculating unit 703. However, simply using the number of characters or words of a text string pronounced provides the same effect even if control unit 704 controls the pronouncing speed of a speech synthesized by speech synthesizing unit 706.

Specifically, in calculating by the number of characters, for the text string "WEATHER IS FINE IN THE NORTHERN AREA" in the example, for instance, the number of the characters is 36 including space characters. Control unit 704 may calculate a readout speed ratio by the formula: (the number of characters)*10 on the basis of the number of characters, for instance. Then, control unit 704 may output 360 (the calculation result) as a readout speed ratio to speech synthesizing unit 706. Control unit 704 may calculate a readout speed ratio on the basis of the number of characters of a text string stored in text string buffer 702.

Meanwhile, in calculating by the number of words, for the text string "WEATHER IS FINE IN THE NORTHERN AREA" in the example, for instance, the number of words is 6. Control unit 704 may calculate a readout speed ratio by the formula: (the number of words)*80 on the basis of the number of words, for instance. Then, control unit 704 may output 480 (the calculation result) as a readout speed ratio to speech synthesizing unit 706. Control unit 704 may thus calculate a readout speed ratio on the basis of the number of words of a text string stored in text string buffer 702.

In this way, the text information presentation device of the embodiment is characterized in that time information on the text string stored in controller memory 705 as a memory is presentation time information 901 and erasing time information 902 associated with the text string input from text information input unit 701. By calculating the speed of speech synthesis using time required to speech-synthesize a text string, and presentation time information and erasing time information on the text string with such a configuration, a text information presentation device can be provided that sets the text string readout speed to an optimum value to ensure audibility even if the frequency of text strings arriving and the number of the characters are not known preliminarily.

Third Exemplary Embodiment

Figure 12:
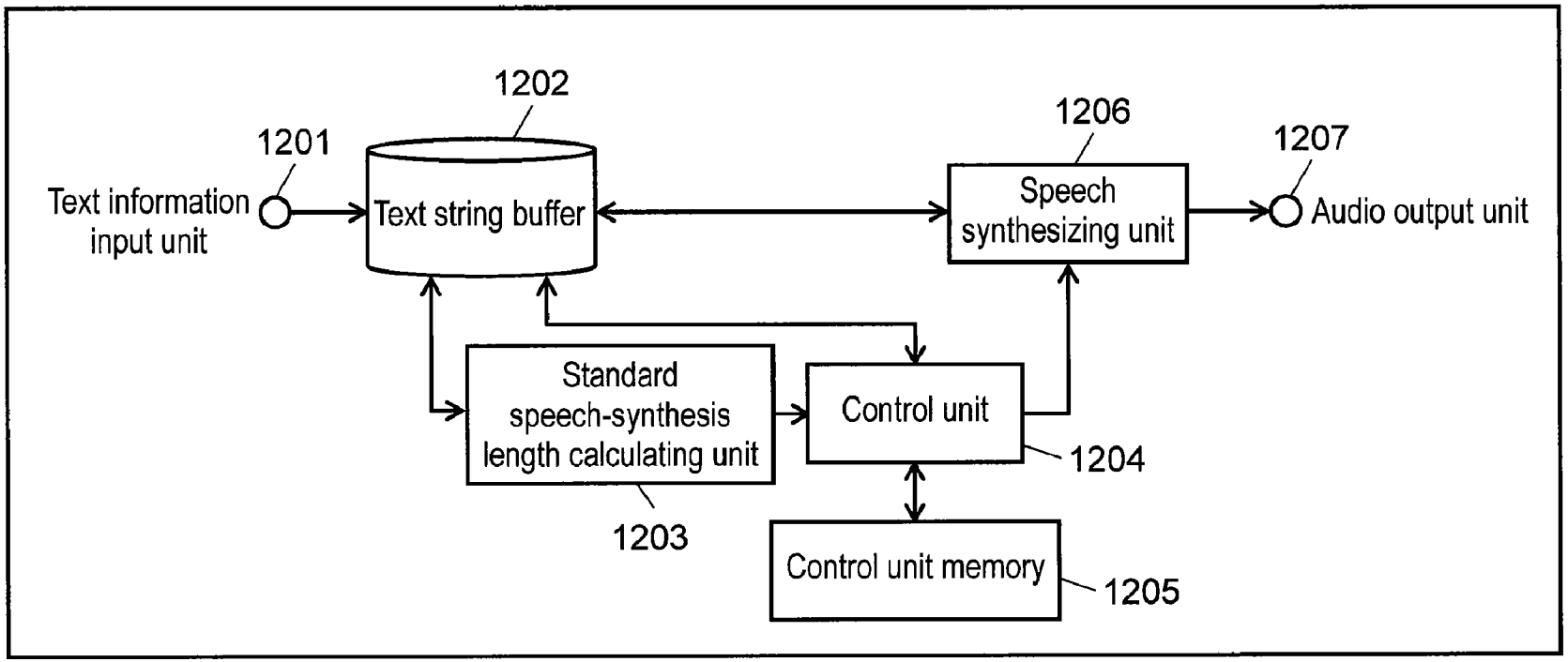
FIG. 12 is a block diagram showing a configuration of the text information presentation device according to the third exemplary embodiment of the present invention.

FIG. 12 is a block diagram showing a configuration of a text information presentation device according to the third exemplary embodiment of the present invention. As shown in FIG. 12, the text information presentation device according to the embodiment includes text information input unit 1201, text string buffer 1202, standard speech-synthesis length calculating unit 1203, control unit 1204, control unit memory 1205 as a memory storing time information on a text string, speech synthesizing unit 1206, and audio output unit 1207. Text information input unit 1201 of the text information presentation device according to the embodiment is different from that according to the first embodiment in that control unit memory 1205 as a memory further stores a history of a given number of readout speed ratio signals. Control unit 1204 is characterized in that it calculates a readout speed ratio signal on the basis of a readout speed ratio signal calculated on the basis of a readout duration signal input from standard speech-synthesis length calculating unit 1203, time information on a text string corresponding to a readout duration signal read from text string buffer 1202, and time information stored in the memory; and a history of a given number of readout speed ratio signals stored in the memory.

Next, a description is made of operation of the text information presentation device according to the embodiment thus configured. Text information input unit 1201, text string buffer 1202, standard speech-synthesis length calculating unit 1203, speech synthesizing unit 1206, and audio output unit 1207 included in the text information presentation device according to the embodiment respectively operate in the same way as text information input unit 101, text string buffer 102, standard speech-synthesis length calculating unit 103, speech synthesizing unit 106, audio output unit 107 included in a text information presentation device according to the first embodiment, and thus their descriptions are omitted.

Control unit 1204 calculates a readout speed ratio signal on the basis of a readout speed ratio signal calculated on the basis of a readout duration signal input from standard speech-synthesis length calculating unit 1203, time information on a text string corresponding to a readout duration signal read from text string buffer 1202, and time information stored in the memory; and a history of a given number of readout speed ratio signals stored in the memory. Control unit memory 1205 as a memory stores a history of a given number of readout speed ratio signals. Control unit 1204 outputs a readout speed ratio signal to speech synthesizing unit 1206 on the basis of a calculation result.

Next, an example is shown of the data structure of time information and a text string stored in text string buffer 1202 using FIG. 13. FIG. 13 schematically shows an example of the data structure of time information and a text string stored in text string buffer 1202 according to the embodiment. In the example, text string buffer 1202 is implemented by software with description as a data structure named as "strbuff" and "stringFIFO". In the example, text string buffer 1202 stores display start time or arriving time of a text string, in the variable "time". Text string buffer 1202 stores up to five text strings, in the variable "str" and in the variable "buff" (details are described later). Text string buffer 1202 further stores the last data position of the text strings stored, in the variable "laststr".

In the example, the variable "str" storing text strings can store a maximum of 256 characters; however, more than that provides the same effect. Meanwhile, even if the text string length ensured is changed according to the length of a text string input, the same effect is provided. In the example, "int64" is 64-bit integer type; char, 8-bit character type; "int", 32-bit integer type. However, the other numbers of bits and the other types provide the same effect. In the embodiment, text string buffer 1202 is implemented with software description defining operation of hardware such as a CPU and memory. Although text string buffer 1202 can be implemented with only hardware, software enables various types of settings to be changed more flexibly, and additionally text string buffer 1202 can be implemented at low cost.

Next, an example is shown of data stored in the data structure of FIG. 13 using FIG. 14. Text string buffers 1, 2, 3, 4, 5 respectively correspond to buff[0], buff[1], buff[2], buff[3], and buff[4] that are variables in the data structure of FIG. 13. Each "buff" contains time information 1401 and stored text string 1402. For instance, time information 1401 contained in text string buffer 1 can be represented as "strfifo.buff[0].time". Stored text string 1402 contained in text string buffer 1 can be represented as "strfifo.buff[0].str".

Time information 1401 in the embodiment is assumed to contain the coordinated universal time (UTC), which is used in general computer languages, representing elapsed seconds from 00:00:00, Jan. 1, 1970. Only hour, minute, and second are shown in FIG. 14; actually year and month are assumed to be included. Here, the embodiment provides the same effect if time information 1401 contains data determined by another method.

The data contained in last data position 1403 shown in FIG. 14 indicates the position of the last data in text string buffer 1202 containing currently valid data. In the state of FIG. 14 for instance, assumption is made that text string buffers 1, 2, 3 contain valid data; and that text string buffers 4, 5 contain null or invalid data. Hence, the data contained in last data position 1403 indicates text string buffer 3 that contains the last data out of valid data. In FIG. 14, last data position 1403 corresponds to variable "laststr" in the example of the data structure of FIG. 13. Time information 1401 contained in text string buffers 1 through 5 is associated with stored text string 1402, and text string buffer 1202 is assumed to store display start time or arriving time of a text string as time information 1401.

Next, a concrete description is made of operation of text string buffer 1202. As shown in the state of data storage in FIG. 14, each of text string buffers 1 through 5 contains time information 1401 and stored text string 1402, and the last data position 1403 indicates text string buffer 3. Time information 1401, stored text string 1402, and the last data position 1403 contained in text string buffer 1202 according to the embodiment are thus respectively the same as time information 301, stored text string 302, and last data position 303 contained in text string buffer 102 according to the first embodiment shown in FIG. 3. Further, both operations when a new text string has been input and when deleting one text string buffer are the same. Hence, their detailed descriptions are omitted.

In this embodiment, up to five text string buffers are assumed to be provided. However, the same effect is provided with the number of text string buffers larger or smaller than that, or changed dynamically.

Hereinafter, a description is made of detailed operation of the text information presentation device according to the embodiment using FIG. 12. As shown in FIG. 12, text string buffer 1202 outputs data stored according to a request from standard speech-synthesis length calculating unit 1203, control unit 1204, and speech synthesizing unit 1206. Data is deleted according to a data delete request issued from speech synthesizing unit 1206 to text string buffer 1202 when speech synthesizing unit 1206 reads data from text string buffer 1202. Further, when text information input unit 1201 inputs a text string to text string buffer 1202, text string buffer 1202 sends an update notification signal representing that data stored has been updated, to standard speech-synthesis length calculating unit 1203, control unit 1204, and speech synthesizing unit 1206.

Figures 15, 16:
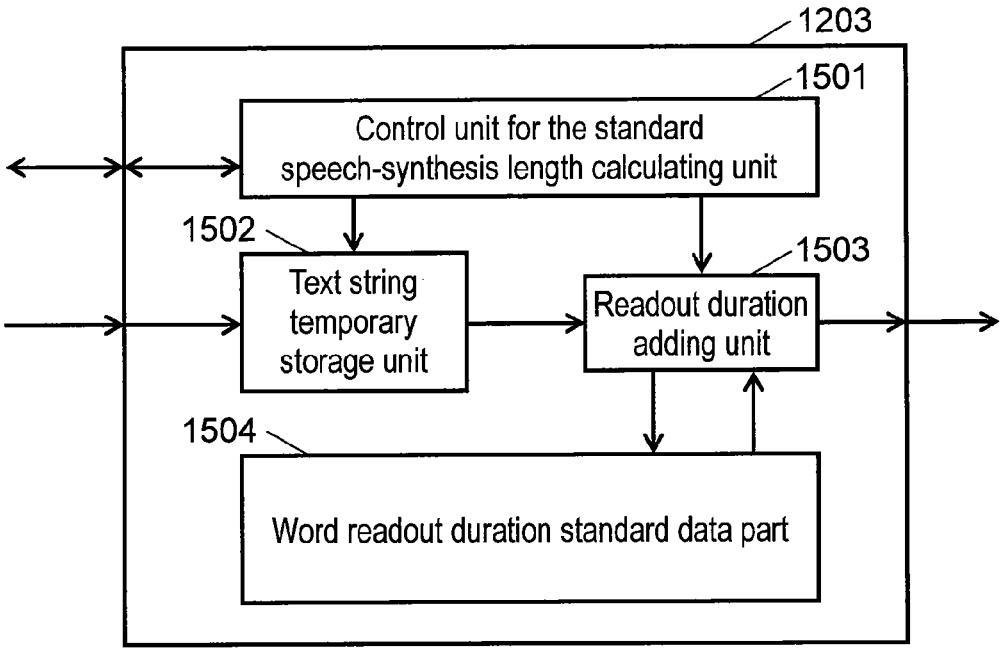
FIG. 15 is a block diagram showing an internal configuration of the standard speech-synthesis length calculating unit according to the third embodiment of the present invention.
FIG. 16 schematically shows an example of data stored in the word readout duration standard data part according to the third embodiment of the present invention.

Standard speech-synthesis length calculating unit 1203 in FIG. 12 calculates time required for speech synthesizing unit 1206 to pronounce a text string in text string buffer 1202 at the standard speed. FIG. 15 is a block diagram showing an internal configuration of standard speech-synthesis length calculating unit 1203. Standard speech-synthesis length calculating unit 1203 includes control unit 1501 for the standard speech-synthesis length calculating unit, text string temporary storage unit 1502, readout duration adding unit 1503, and word readout duration standard data part 1504.

Next, a description is made of operation of standard speech-synthesis length calculating unit 1203 thus configured. Operation of control unit 1501 for the standard speech-synthesis length calculating unit, text string temporary storage unit 1502, readout duration adding unit 1503, and word readout duration standard data part 1504 included in standard speech-synthesis length calculating unit 1203 according to the embodiment are respectively the same as those of control unit 401 for the standard speech-synthesis length calculating unit, text string temporary storage unit 402, readout duration adding unit 403, and word readout duration standard data part 404 included in standard speech-synthesis length calculating unit 103 according to the first embodiment, and thus their descriptions are omitted.

Next, an example is shown of data stored in word readout duration standard data part 1504 using FIG. 16. As an example of data, the column of word 1601 (described as "word1601" in FIG. 16); and the column of readout duration 1602 (described as "duration1602" in FIG. 16) that is time required to pronounce word 1601 at the standard speed are shown. The process for word 1601, and readout duration 1602 in the embodiment are the same as those of word 501 and readout duration 502 in the first embodiment shown in FIG. 5, and thus their detailed descriptions are omitted.

Next, a description is made of text string arrival time information 1701 and readout speed ratio history information 1702 stored in control unit memory 1205; and of the calculating process in control unit 1204 using FIG. 17. As shown in FIG. 17, control unit memory 1205 as a memory included in the text information presentation device according to the embodiment further stores a history of a given number of readout speed ratio signals. Control unit 1204 is characterized in that it calculates a readout speed ratio signal on the basis of a readout speed ratio signal calculated on the basis of a readout duration signal input from standard speech-synthesis length calculating unit 1203, time information on a text string corresponding to a readout duration signal read from text string buffer 1202, and time information stored in the memory; and a history of a given number of readout speed ratio signals stored in the memory.

Concretely, when stored text string arrival time information 1701 and readout speed ratio history information 1702 are newly input, control unit memory 1205 shifts downward stored text string arrival time information and readout speed ratio history information stored as shown in FIG. 17, which means that stored text string arrival time information and readout speed ratio history information stored in time information 5 are discarded. Then, control unit memory 1205 stores stored text string arrival time information and readout speed ratio history information newly input to time information 1. In this way, the last five sets of stored text string arrival time information and readout speed ratio history information are stored. That is, in the embodiment, the given number is assumed to be 5 as an example. However, the given number may be other than 5. The same effect is provided with a given number larger or smaller than 5, or changed dynamically.

In the example of FIG. 17, the text string "12:00:00" (i.e. stored text string arrival time information) is stored in stored text string arrival time information 1701 of time information 1. In the example, a description is made for a state after control unit 1204 has processed the text string "12:00:00" (i.e. time information 1401) and the text string "NEXT IS WEATHER FORCAST" (i.e. stored text string 1402) that have been stored in text string buffer 1 shown in FIG. 14. Control unit 1204, when receiving a readout duration signal from standard speech-synthesis length calculating unit 1203, reads time information 1401 and stored text string 1402 from text string buffer 1202. When control unit 1204 processes the text string "12:00:03" (i.e. time information 1401) and the text string "WEATHER IS FINE IN THE NORTHERN AREA" (i.e. stored text string 1402) as calculation-target data, standard speech-synthesis length calculating unit 1203 first calculates time required for speech synthesizing unit 1206 to pronounce the text string "WEATHER IS FINE IN THE NORTHERN AREA" at the standard speed.

For this calculation, a readout duration signal output from standard speech-synthesis length calculating unit 1203 can be used. Instead, control unit 1204 may calculate a readout duration using the table of FIG. 16. The result shows pronouncing only words requires 10.5 seconds. If six space characters between each word require 0.5 seconds each, time to pronounce the text string at the standard speed requires another 3 seconds. Hence, time required for speech synthesizing unit 1206 to pronounce the text string "WEATHER IS FINE IN THE NORTHERN AREA" at the standard speed is determined as 13.5 seconds. Then, control unit 1204 reads the text string "12:00:00" (i.e. time information 1701 of time information 1) stored in control unit memory 1205 and determines the time difference from the text string "12:00:03" (i.e. time information 1401 of calculation-target data). In this case, the time difference calculated is 3 seconds.

Next, control unit 1204 calculates a readout speed ratio required to complete pronouncing the text string "WEATHER IS FINE IN THE NORTHERN AREA" that requires 13.5 seconds for speech synthesizing unit 1206 to pronounce at the standard speed, in 3 seconds (the time difference calculated). The next formula provides a readout speed ratio (e.g. 100 when pronounced at the standard speed). That is, (readout speed ratio)=(time required when pronounced at the standard speed)/(time difference)*100.

In the example, the above-described formula provides a readout speed ratio of 13.5/3*100=450. Next, control unit 1204 sums the values calculated, namely five of each readout speed ratio history information 1702 stored in control unit memory 1205. In the example, it is 450+(400+350+320+400+380)=2300. Then, to derive an average value, the value 2300 is divided by (1+5), where the value after the decimal point is rounded off. This calculation result is 2300/6=383. Then, control unit 1204 outputs this calculation result as a readout speed ratio to speech synthesizing unit 1206.

Here, in this embodiment, control unit 1204 calculates a readout speed ratio output to speech synthesizing unit 1206 by averaging the previous history. Instead, the readout speed ratio immediately preceding may be changed within a preliminarily determined ratio. Consequently, control unit 1204 can exercise control so that a readout speed ratio output to speech synthesizing unit 1206 does not change rapidly, and thus the same effect as this embodiment is provided.

Speech synthesizing unit 1206, when receiving a readout speed ratio signal from control unit 1204, reads a text string from text string buffer 1202 to read out the text string at the readout speed ratio represented by the readout speed ratio signal received. The speed of pronouncing a speech synthesized by speech synthesizing unit 1206 is equal to the standard speed calculated by standard speech-synthesis length calculating unit 1203 when the readout speed ratio output from control unit 1204 is 100, and varies proportionally to the readout speed ratio output from control unit 1204. For instance, when the readout speed ratio output from control unit 1204 is 200, a speech is pronounced at a speed twice the standard speed calculated by standard speech-synthesis length calculating unit 1203. Consequently, time required to pronounce is half. On the other hand, when the readout speed ratio output from control unit 1204 is 50, a speech is pronounced at a speed half the standard speed calculated by standard speech-synthesis length calculating unit 1203. Consequently, time required to pronounce is twice.

Here, in the embodiment, time information 1401 in text string buffer 1202 is associated with stored text string 1402. Hence, text string buffer 1202 stores the time point when a text string has been input from text information input unit 1201 to text string buffer 1202, as time information 1401. However, when time information, along with a text string, has been input from text information input unit 1201, the same effect is provided even if the time information input along with the text string is to be stored in text string buffer 1202, instead of the time point when the text string is input to text string buffer 1202 by text information input unit 1201. In subtitle information used in TV broadcasting, for instance, time information representing a time of day displayed on a screen is sent along with text strings. As a result that the time of day displayed on the screen is stored and used as time information 1401 in text string buffer 1202, speech synthesis more suitable for subtitles can be performed.

Here, in the embodiment, control unit 1204 controls the pronouncing speed of a speech synthesized by speech synthesizing unit 1206, using the standard speed calculated by standard speech-synthesis length calculating unit 1203. However, the same effect is provided even if control unit 1204 controls the pronouncing speed of a speech synthesized by speech synthesizing unit 1206 simply using the number of characters or words of a text string pronounced. Specifically, in calculating by the number of characters, for the text string "WEATHER IS FINE IN THE NORTHERN AREA" in the example, for instance, the number of characters is 36 including space characters. Control unit 1204 may calculate a readout speed ratio by the formula: (the number of characters)*10 on the basis of the number of characters, for instance. Then, control unit 1204 may output 360 (the calculation result) as a readout speed ratio to speech synthesizing unit 1206.

Meanwhile, in calculating by the number of words, for the text string "WEATHER IS FINE IN THE NORTHERN AREA" in the example, for instance, the number of words is 6. Control unit 1204 may calculate a readout speed ratio by the formula: (the number of words)*80 on the basis of the number of words, for instance. Then, control unit 1204 may output 480 (the calculation result) as a readout speed ratio to speech synthesizing unit 1206.

In this way, the text information presentation device of the embodiment uses time required to speech-synthesize a text string and a time interval at which text strings are input; or time required to speech-synthesize a text string and an interval at which time information is input along with a text string. Further, the text information presentation device averages previous calculation results to calculate the speed of speech synthesis. Consequently, the text information presentation device can be provided that sets the text string readout speed to an optimum value to ensure audibility and that suppresses rapid changes in the speed ratio of reading out text strings even if the frequency of text strings arriving and the number of the characters are not known preliminarily.

Fourth Exemplary Embodiment

Figure 18:
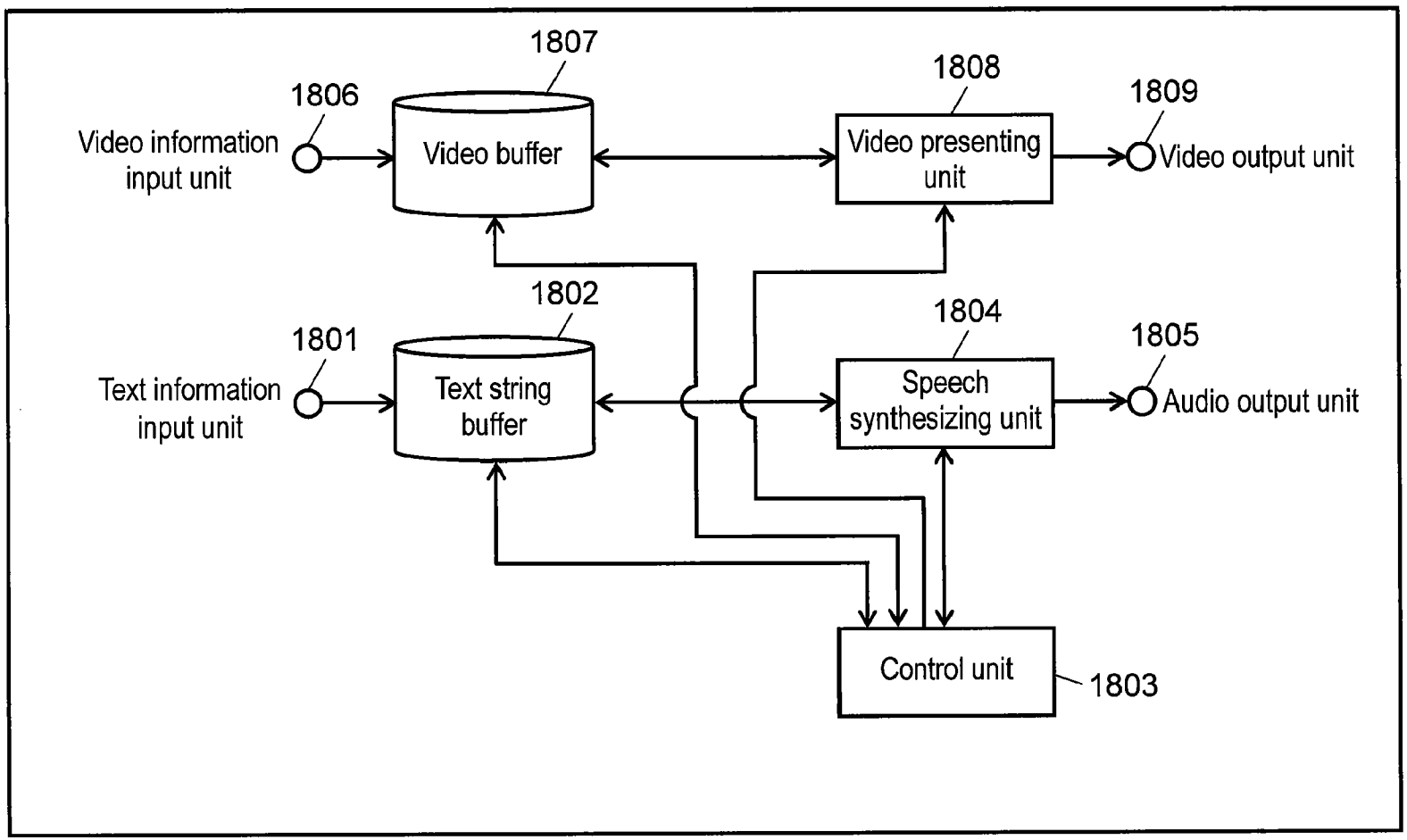
FIG. 18 is a block diagram showing a configuration of the text information presentation device according to the fourth exemplary embodiment of the present invention.

FIG. 18 is a block diagram showing a configuration of a text information presentation device according to the fourth exemplary embodiment of the present invention. As shown in FIG. 18, the text information presentation device according to the embodiment includes text information input unit 1801, text string buffer 1802, control unit 1803, speech synthesizing unit 1804, video information input unit 1806, video buffer 1807, video presenting unit 1808, video output unit 1809, and audio output unit 1810. This embodiment is different from the first one in that the text information presentation device according to the embodiment further includes video information input unit 1806, video buffer 1807, video presenting unit 1808, and video output unit 1809; that the device does not include standard speech-synthesis length calculating unit 103 or control unit memory 105 shown in FIG. 1; and that control unit 1803 controls text string buffer 1802, speech synthesizing unit 1804, video buffer 1807, and video presenting unit 1808 (details are described later).

Next, a description is made of operation of the text information presentation device according to the embodiment thus configured. Text information input unit 1801 accepts input of a text string. Then, the text string input from text information input unit 1801 is input to text string buffer 1802 and stored there. Text string buffer 1802 outputs a text string according to a request from control unit 1803 and speech synthesizing unit 1804. When a new text string is input from text information input unit 1801 and stored in text string buffer 1802, text string buffer 1802 issues an update notification signal to control unit 1803.

Speech synthesizing unit 1804 monitors text string buffer 1802 in a state not performing speech synthesis process. Then, speech synthesizing unit 1804, when detecting that a text string yet to be speech-synthesized is stored, reads the text string from text string buffer 1802 to start speech synthesis. Then, speech synthesizing unit 1804 speech-synthesizes the text string at the standard speed to output an audio signal to audio output unit 1810. On the other hand, speech synthesizing unit 1804, when completing speech synthesis process, requests text string buffer 1802 to delete data of a text string completed from text string buffer 1802. Here, the standard speed is assumed to be a standard speed as represented by that pronounced by an announcer for instance.

Control unit 1803, when receiving an update notification signal from text string buffer 1802, checks the state of speech synthesizing unit 1804. If speech synthesizing unit 1804 has not completed the speech synthesis process, control unit 1803 requests video presenting unit 1808 to temporarily stop video. Then, video buffer 1807 temporarily stores video information input from video information input unit 1806.

Video presenting unit 1808 (e.g. video decoder) reads a video signal from video buffer 1807 to output it to video output unit 1809. Here, video presenting unit 1808, when receiving a request for temporarily stopping a video signal from control unit 1803, stops reading video information from video buffer 1807 and outputs a video signal in a nonmoving state. Meanwhile, control unit 1803, when detecting that speech synthesizing unit 1804 has completed speech synthesis process after control unit 1803 issues a temporary stop request to video presenting unit 1808, requests video presenting unit 1808 to resume replaying a video signal. That is, if speech synthesizing unit 1804 has not completed outputting an audio signal synthesized, video presenting unit 1808 outputs a video signal in a nonmoving state under the control of control unit 1803.

Next, an example is shown of data stored in text string buffer 1802 using FIG. 19. Text string buffers 1, 2, 3, 4, 5 are assumed to be able to store text strings of up to 256 characters each. Each text string stored is called stored text string 1901. Here, this embodiment provides the same effect with the number of characters containable larger or smaller than 256, or changed dynamically. The data stored in last data position 1902 indicates the position of the last data in text string buffer 1802 containing currently valid data. In the state of FIG. 19 for instance, assumption is made that text string buffers 1, 2, 3 contain valid data; and that text string buffers 4, 5 contain null or invalid data. Hence, the data contained in last data position 1902 indicates text string buffer 3.

In the state of data storage shown in FIG. 19, when the text string "TOMORROW'S FORECAST IS SUNNY IN ALL THE AREA" is input, the text string is stored in stored text string 1901 of text string buffer 4 that is the next empty text string buffer, and last data position 1902 indicates text string buffer 4.

In the state of data storage shown in FIG. 19, when a direction is made to delete one text string buffer, the data stored in text string buffer 2 is copied to text string buffer 1. Then, the data stored in text string buffer 3 is copied to text string buffer 2. Further, the data stored in text string buffer 4 is copied to text string buffer 3. Still, the data stored in text string buffer 5 is copied to text string buffer 4. Then, last data position 1902 is changed so as to indicate the next upper text string buffer from text string buffer 1802 currently indicated in FIG. 19 (i.e. text string buffer 2 in the state of data storage shown in FIG. 19).

As described above, data is assumed to be always deleted from text string buffer 1 in the embodiment. Then, subsequent data is assumed to be shifted while copying text string buffer 2 to text string buffer 1; text string buffer 3 to text string buffer 2; and so on. Alternatively, in addition to the elements of the data structure, a variable indicating a start data position may be added, where the start data position may indicate data to be deleted. Specifically, when data has been deleted, the start data position is changed so as to indicate text string buffer 2 when the start data position currently indicates text string buffer 1 for instance. The start data position may be changed so as to indicate text string buffer 3 when the start data position currently indicates text string buffer 2. This method increases the process speed while providing the same effect. In this embodiment, up to five text string buffers are assumed to be provided. However, the same effect is provided with the number of text string buffers larger or smaller than that, or changed dynamically.

Here, if speech synthesizing unit 1804 has not completed speech synthesis process, control unit 1803 requests video presenting unit 1808 to change the video presenting speed instead of requesting video presenting unit 1808 to temporarily stop outputting a video signal. This enables video to be presented to viewers with less unnatural feeling. For instance, when video presenting unit 1808 receives a request to decrease the video presenting speed from control unit 1803, video presenting unit 1808 reads video information from video buffer 1807 less frequently and outputs it to video output unit 1809. On the other hand, when video presenting unit 1808 receives a request to increase the video presenting speed from control unit 1803, video presenting unit 1808 reads video information from video buffer 1807 more frequently and outputs it to video output unit 1809. In other words, if speech synthesizing unit 1804 has not completed outputting an audio signal synthesized, video presenting unit 1808 does not completely stop outputting a video signal temporarily, but outputs a video signal with its presenting speed changed under the control of control unit 1803. If video presenting unit 1808 is an MPEG2 decoder for instance, video presenting unit 1808 can exercise control so as to change the video presenting speed by changing the speed of counting up the STC (system time clock) in the MPEG2 decoder.

The text information presentation device according to the embodiment thus includes video information input unit 1806 accepting input of video information; video buffer 1807 storing video information having been input to video information input unit 1806; and video presenting unit 1808 that reads video information from video buffer 1807, decodes it, and outputs it as a video signal. The text information presentation device further includes control unit 1803 controlling at least video presenting unit 1808. Then, in the text information presentation device, video presenting unit 1808 outputs a video signal while controlling its speed if text information being input is presented too slowly, namely speech synthesizing unit 1804 has not completed outputting an audio signal synthesized. Consequently, a text information presentation device can be provided that temporarily stops presenting video information being input or changes the presenting speed to ensure reading out text strings and audibility even if the frequency of text strings arriving and the number of the characters are not known preliminarily.

Figure 20:
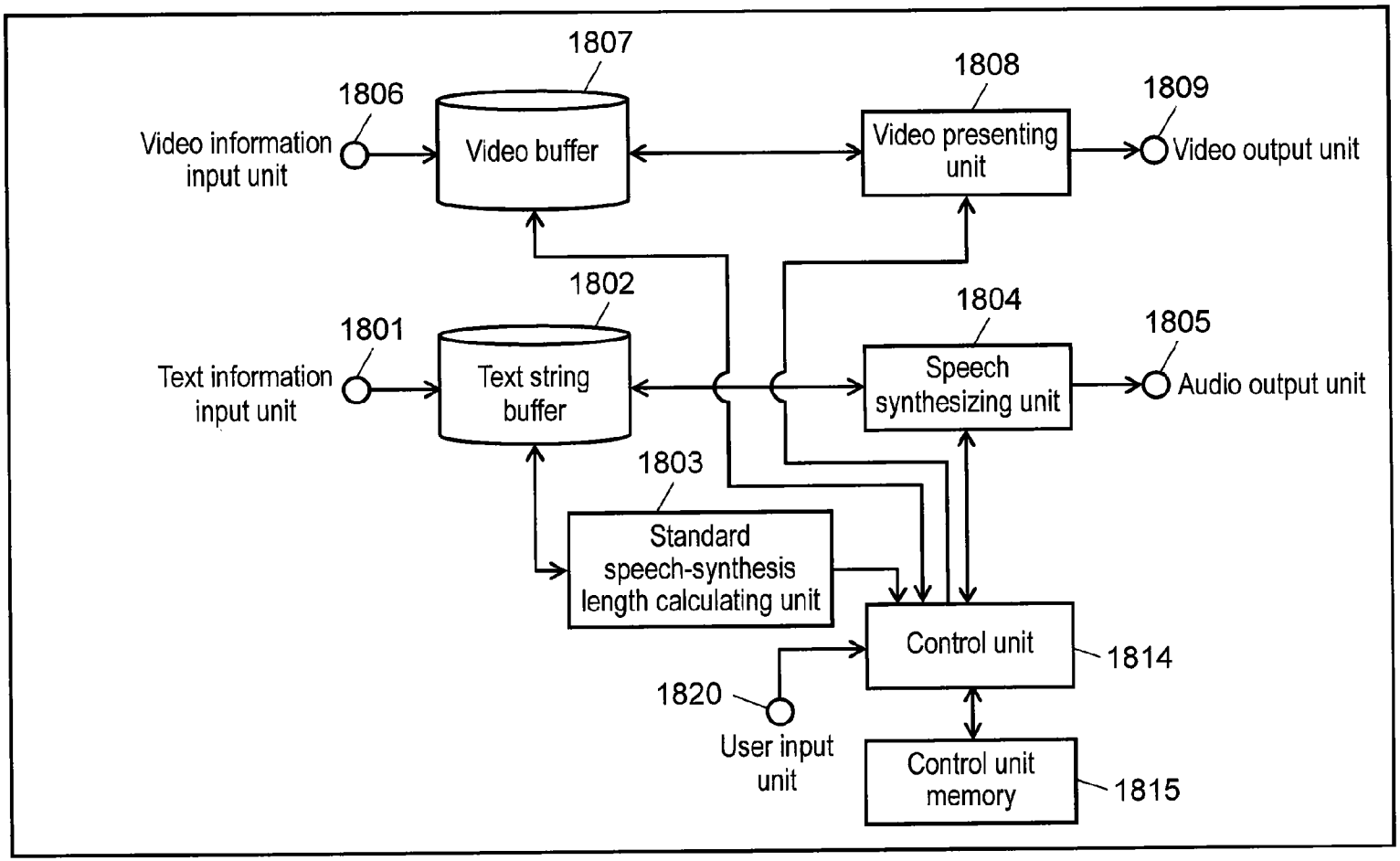
FIG. 20 is a block diagram showing another configuration of the text information presentation device according to the fourth embodiment of the present invention.
Figure 21:
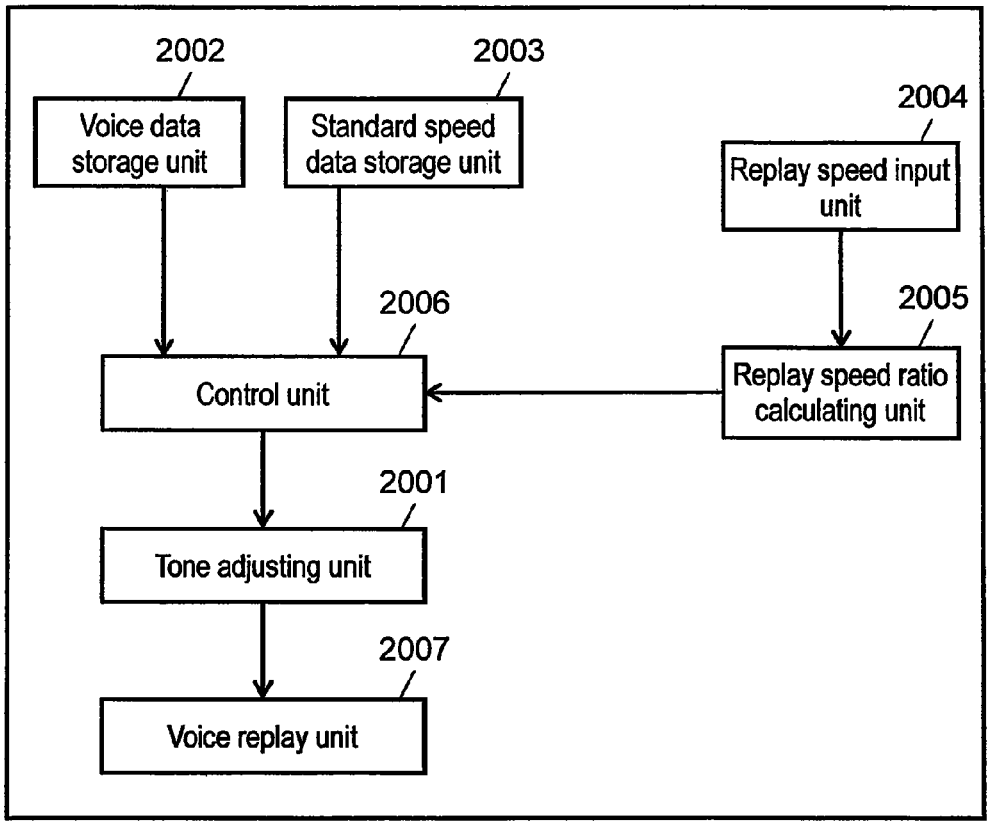
FIG. 21 PRIOR ART
FIG. 21 is a block diagram showing a configuration of a conventional text string readout unit.

The text information presentation device according to the embodiment is assumed to temporarily stops presenting video information being input or to change the presenting speed under the control of control unit 1803. However, as shown in FIG. 20, audio information may be processed with the configuration shown in the embodiments first through third, combined with the configuration to control presenting video information according to the embodiment. Further, arrangement may be made so that changing the presenting speed of the text information presentation device can be selected for process of audio information or video information, according to user setting. This arrangement is effective when either audio information or video information is desired to be reproduced with a maximum of fidelity to the intent of the send-out side.

FIG. 20 is a block diagram showing another example configuration of the text information presentation device according to the fourth embodiment of the present invention. As shown in the figure, the another example text information presentation device includes text information input unit 1801, text string buffer 1802, speech synthesizing unit 1804, video information input unit 1806, video buffer 1807, video presenting unit 1808, video output unit 1809, audio output unit 1810, standard speech-synthesis length calculating unit 1814, control unit 1803, control unit memory 1805, and user input unit 1820.

That is, the another example text information presentation device further includes standard speech-synthesis length calculating unit 1814, control unit memory 1805, and user input unit 1820, in addition to the configuration of FIG. 18. The process of changing the presenting speed of audio information using text information input unit 1801, text string buffer 1802, speech synthesizing unit 1804, audio output unit 1810, standard speech-synthesis length calculating unit 1814, control unit 1803, and control unit memory 1805 is the same as that of the embodiments already described, and thus its detailed description is omitted.

The process of changing the presenting speed of video information using text information input unit 1801, text string buffer 1802, speech synthesizing unit 1804, audio output unit 1810, video information input unit 1806, video buffer 1807, video presenting unit 1808, video output unit 1809, and control unit 1803 is the same as that of this embodiment already described, and thus its detailed description is omitted.

Hence, a description is made of configurations and operation of the another example text information presentation device different from the others. That is, the another example text information presentation device further includes video information input unit 1806 accepting input of video information; video buffer 1807 storing video information having been input to video information input unit 1806; and video presenting unit 1808 that reads video information from video buffer 1807, decodes it, and outputs it as a video signal. Then, control unit 1803 controls at least video presenting unit 1808 and is connected to user input unit 1820 from which a select signal is input. If the select signal indicates selection of video information, video presenting unit 1808 outputs a video signal while controlling its speed under the control of control unit 1803 if speech synthesizing unit 1804 has not completed outputting an audio signal synthesized on the basis of time required to pronounce at a given speed.

Meanwhile, if the select signal indicates selection of audio information, video presenting unit 1808 outputs a video signal at regular speed while controlling its speed, and speech synthesizing unit 1804 speech-synthesize a text string input from text string buffer 1802 on the basis of a readout speed ratio signal under the control of control unit 1803.

Next, a description is made of detailed operation of control unit 1803. Control unit 1803 is connected to the output of user input unit 1820. User input unit 1820 is applied with a select signal indicating whether the text information presentation device outputs a video signal at regular speed or outputs an audio signal synthesized at the standard speed, according to a user selection. In other words, a select signal contains data indicating that the user selection is audio information or video information. Concretely, the data may be "true" and "false" as a logic signal for instance. Alternatively, a select signal may be that of 0 to 1 V for audio information; 4 to 5 V for video information so that they are discriminated as two different signals, for instance. Here, user selection can be made such as from a remote control unit and touch panel.

A select signal output from user input unit 1820 is input to control unit 1803. When the select signal contains data indicating "video information selected", video presenting unit 1808 outputs a video signal while controlling its speed under the control of control unit 1803 if speech synthesizing unit 1804 has not completed outputting an audio signal synthesized on the basis of time required to pronounce at a given speed.

Meanwhile, when the select signal contains data indicating "audio information selected", video presenting unit 1808 outputs a video signal at regular speed while controlling its speed under the control of control unit 1803, and speech synthesizing unit 1804 speech-synthesize a text string input from text string buffer 1802 on the basis of a readout speed ratio signal under the control of control unit 1803.

With such a configuration, the readout speed ratio of a text string can be calculated on the basis of user selection to present text information while changing the readout speed ratio. Further, presenting video information being input can be temporarily stopped or the presenting speed can be changed on the basis of user selection. Consequently, a text information presentation device can be provided that ensures reading out text strings and audibility on the basis of the content of video and text information according to user selection even if the frequency of text strings arriving and the number of the characters are not known preliminarily.

INDUSTRIAL APPLICABILITY

A text information presentation device according to the present invention allows viewers to easily finish reading or sets the text string readout speed to an optimum value to ensure audibility even if the frequency of text strings arriving and the number of the characters are not known preliminarily, which is useful as a text information presentation device that displays text information; or converts text information to voice and outputs it.

The invention claimed is:

1. A text information presentation device comprising:

a memory storing time information on a text string;

a text information input unit accepting input of the text string;

a text string buffer that stores the text string and outputs an update notification signal when the text string is input to the text information input unit;

a standard speech-synthesis length calculating unit that reads the text string stored in the text string buffer and calculates time required to pronounce the text string at a given speed to output the time as a readout duration signal when receiving the update notification signal;

a control unit that calculates a readout speed ratio on a basis of the readout duration signal output from the standard speech-synthesis length calculating unit, time information on a text string stored in the text string buffer, and the time information on the text string stored in the memory, and output the readout speed ratio as a readout speed ratio signal; and a speech synthesizing unit that issues a readout request to the text string buffer, and speech-synthesizes a text string input from the text string buffer on a basis of the readout speed ratio signal, wherein the memory further stores a history of a given number of readout speed ratio signals, and wherein the control unit calculates a readout speed ratio signal on a basis of a readout speed ratio signal calculated on a basis of the readout duration signal input from the standard speech-synthesis length calculating unit, the time information corresponding to the readout duration signal and having been read from the text string buffer, and the time information on the text string stored in the memory; and the history of the given number of the readout speed ratio signals stored in the memory.

2. The text information presentation device of claim 1, wherein the time information on the text string stored in the memory is updated to the time information on the text string read from the text string buffer when the control unit calculates a readout speed ratio signal.

3. The text information presentation device of claim 1, wherein the time information on the text string stored in the memory is presentation time information associated with the text string having been input from the text string input unit.

4. The text information presentation device of claim 1, wherein the time information on the text string stored in the memory is presentation time information and erasing time information associated with the text string that has been input from the text string input unit.

5. The text information presentation device of claim 1, wherein, when the text string input from the text information input unit includes a word not present in the speech-synthesis length calculating unit, the text string is divided into a word present in the speech-synthesis length calculating unit and adds time information on the word having been divided.

6. The text information presentation device of claim 1, wherein the control unit calculates the readout speed ratio on a basis of the number of characters of the text string stored in the text string buffer.

7. The text information presentation device of claim 1, wherein the control unit calculates the readout speed ratio on a basis of the number of words of the text string stored in the text string buffer.

8. The text information presentation device of claim 1, further comprising:

a video information input unit accepting input of video information;

a video buffer storing the video information having been input to the video information input unit; and a video presenting unit that reads the video information from the video buffer, decodes the video information, and outputs the video information as a video signal, wherein the control unit controls at least the video presenting unit and is connected to a user input unit from which a select signal is input, and wherein, when the select signal indicates selection of video information, the video presenting unit outputs the video signal while controlling speed at which the video signal is output under control of the control unit when the speech synthesizing unit has not completed outputting the audio signal synthesized on a basis of time required to pronounce at the given speed, and when the select signal indicates selection of audio information, the video presenting unit outputs the video signal at regular speed while controlling speed at which the video signal is output under control of the control unit, and the speech synthesizing unit speech-synthesizes a text string input from the text string buffer on a basis of the readout speed ratio signal under control of the control unit.

9. The text information presentation device of claim 1, further comprising:

a video information input unit accepting input of video information;

a video buffer storing the video information having been input to the video information input unit; and a video presenting unit that reads the video information from the video buffer, decodes the video information, and outputs the video information as a video signal, wherein the control unit controls at least the video presenting unit and the speech synthesizing unit and is connected to a user input unit from which a select signal is input, and changes presenting speed depending on process of audio information or of video information on a basis of the select signal.

10. The text information presentation device of claim 8, wherein, when the speech synthesizing unit has not completed outputting the audio signal synthesized, the video presenting unit outputs the video signal in a nonmoving state under control of the control unit.

11. The text information presentation device of claim 8, wherein, when the speech synthesizing unit has not completed outputting the audio signal synthesized, the video presenting unit outputs the video signal by changing presenting speed of the video signal under control of the control unit.

12. The text information presentation device of claim 9, wherein, when the speech synthesizing unit has not completed outputting the audio signal synthesized, the video presenting unit outputs the video signal in a nonmoving state under control of the control unit.

13. The text information presentation device of claim 9, wherein, when the speech synthesizing unit has not completed outputting the audio signal synthesized, the video presenting unit outputs the video signal by changing presenting speed of the video signal under control of the control unit.

* * * * *

UNITED STATES PATENT AND TRADEMARK OFFICE

CERTIFICATE OF CORRECTION

PATENT NO. : 8,370,150 B2
APPLICATION NO. : 12/669278
DATED : February 5, 2013
INVENTOR(S) : Keiichi Toiyama et al.

It is certified that error appears in the above-identified patent and that said Letters Patent is hereby corrected as shown below:

On the Title Page, item (56) at FOREIGN PATENT DOCUMENTS, please delete the following duplicate references:

"JP 06-067685 3/1994"
"JP 2005-062420 A 3/2005" and
"JP 2005-316031 A 11/2005".

On the Title Page, item (56) at FOREIGN PATENT DOCUMENTS, please replace "WO PCT/JP2008/001892 10/2008" with -- International Search Report for International Application No. PCT/JP2008/001892 10/07/2008 Panasonic Corporation --.

Signed and Sealed this
Fourth Day of June, 2013

Teresa Stanek Rea
*Acting Director of the United States Patent and Trademark Office*